US009481031B2

(12) United States Patent
Han et al.

(10) Patent No.: US 9,481,031 B2
(45) Date of Patent: Nov. 1, 2016

(54) ULTRASONIC GRAIN REFINING

(71) Applicant: HANS TECH, LLC, West Lafayette, IN (US)

(72) Inventors: Qingyou Han, West Lafayette, IN (US); Lu Shao, West Lafayette, IN (US); Clause Xu, West Lafayette, IN (US)

(73) Assignee: HANS TECH, LLC, West Lafayette, IN (US)

( * ) Notice: Subject to any disclaimer, the term of this patent is extended or adjusted under 35 U.S.C. 154(b) by 0 days.

(21) Appl. No.: 15/019,375

(22) Filed: Feb. 9, 2016

(65) Prior Publication Data

US 2016/0228943 A1 Aug. 11, 2016

Related U.S. Application Data

(60) Provisional application No. 62/113,882, filed on Feb. 9, 2015.

(51) Int. Cl.

| | |
|---|---|
| ***B22D 1/00*** | (2006.01) |
| ***B22D 11/114*** | (2006.01) |
| ***B22D 11/22*** | (2006.01) |

(Continued)

(52) U.S. Cl.

CPC ..... *B22D 1/007* (2013.01); *B22D 11/114* (2013.01); *B22D 11/117* (2013.01); *B22D 11/141* (2013.01); *B22D 11/144* (2013.01); *B22D 11/22* (2013.01); *B22D 21/007* (2013.01); *B22D 35/04* (2013.01); *B22D 35/06* (2013.01); *B22D 37/00* (2013.01)

(58) Field of Classification Search

CPC ..... B22D 1/00; B22D 11/114; B22D 11/14; B22D 11/22; B22D 21/00; B22D 35/04; B22D 35/06; B22D 37/00

USPC ..... 164/478, 416, 48, 501, 505

See application file for complete search history.

(56) References Cited

U.S. PATENT DOCUMENTS

| | | | |
|---|---|---|---|
| 1,318,740 | A | 10/1919 | Fessenden |
| 2,408,627 | A | 10/1946 | Green |

(Continued)

FOREIGN PATENT DOCUMENTS

| | | |
|---|---|---|
| CN | 101775518 | 7/2010 |
| CN | 101829777 | 9/2010 |

(Continued)

OTHER PUBLICATIONS

T.V. Atamenenko, et al. "Criteria of Grain Refinement Induced by Ultrasonic Melt Treatment of Aluminum Alloys Containing Zr and Ti," Metallurgical and Materials Transactions, vol. 41A, pp. 2056-2066, Aug. 2010.

(Continued)

*Primary Examiner* — Kevin P Kerns

(74) *Attorney, Agent, or Firm* — Oblon, McClelland, Maier & Neustadt, L.L.P.

(57) ABSTRACT

A molten metal processing device including a molten metal containment structure for reception and transport of molten metal along a longitudinal length thereof. The device further includes a cooling unit for the containment structure including a cooling channel for passage of a liquid medium therein, and an ultrasonic probe disposed in relation to the cooling channel such that ultrasonic waves are coupled through the liquid medium in the cooling channel and through the molten metal containment structure into the molten metal.

29 Claims, 25 Drawing Sheets

(51) Int. Cl.

| | |
|---|---|
| ***B22D 35/06*** | (2006.01) |
| ***B22D 11/14*** | (2006.01) |
| ***B22D 21/00*** | (2006.01) |
| ***B22D 37/00*** | (2006.01) |
| ***B22D 35/04*** | (2006.01) |
| ***B22D 11/117*** | (2006.01) |

(56) References Cited

U.S. PATENT DOCUMENTS

| | | | | |
|---|---|---|---|---|
| 2,419,373 | A | 4/1947 | Schrumn | |
| 2,514,797 | A | 7/1950 | Robinson | |
| 2,615,271 | A | 10/1952 | Ulmer et al. | |
| 2,763,040 | A | 9/1956 | Korb | |
| 2,820,263 | A | 1/1958 | Fruengel | |
| 2,897,557 | A | 8/1959 | Ornitz | |
| 2,973,564 | A | 3/1961 | Dixon et al. | |
| 3,045,302 | A | 7/1962 | Patton | |
| 3,270,376 | A | 9/1966 | Thulmann | |
| 3,276,082 | A | 10/1966 | Thomas | |
| 3,395,560 | A | 8/1968 | Cofer et al. | |
| 3,461,942 | A | 8/1969 | Hoffman et al. | |
| 3,512,401 | A | 5/1970 | Thalmann | |
| 3,596,702 | A | 8/1971 | Ward et al. | |
| 3,678,988 | A | 7/1972 | Tien et al. | |
| 3,938,991 | A | 2/1976 | Sperry et al. | |
| 4,066,475 | A | 1/1978 | Chia | |
| 4,211,271 | A | 7/1980 | Ward | |
| 4,221,257 | A | 9/1980 | Narasimhan | |
| 4,288,398 | A * | 9/1981 | Lemelson | B21C 31/00 264/443 |
| 4,573,521 | A | 3/1986 | Artz et al. | |
| 4,582,117 | A | 4/1986 | Kushnick | |
| 4,662,427 | A | 5/1987 | Larrecq et al. | |
| 4,733,717 | A | 3/1988 | Chia et al. | |
| 5,281,251 | A | 1/1994 | Kenny et al. | |
| 5,334,236 | A | 8/1994 | Sang et al. | |
| 5,355,935 | A | 10/1994 | Nogues | |
| 5,935,295 | A | 8/1999 | Megy | |
| 6,217,632 | B1 | 4/2001 | Megy | |
| 6,253,831 | B1 | 7/2001 | Genma et al. | |
| 6,336,495 | B1 | 1/2002 | McCullough et al. | |
| 7,131,308 | B2 | 11/2006 | McCullough et al. | |
| 7,164,096 | B1 | 1/2007 | Gordon et al. | |
| 7,820,249 | B2 | 10/2010 | Nayar et al. | |
| 7,837,811 | B2 | 11/2010 | Motegi et al. | |
| 8,236,231 | B2 | 8/2012 | Ferguson et al. | |
| 8,574,336 | B2 | 11/2013 | Rundquist et al. | |
| 2004/0055735 | A1 | 3/2004 | Hong et al. | |
| 2004/0211540 | A1 | 10/2004 | Hong et al. | |
| 2005/0011631 | A1* | 1/2005 | Hong | B22D 1/00 164/498 |
| 2007/0235445 | A1* | 10/2007 | Wilgen et al. | H05B 6/101 219/635 |
| 2011/0030914 | A1 | 2/2011 | Farina | |
| 2011/0303866 | A1 | 12/2011 | Li et al. | |
| 2012/0168040 | A1 | 7/2012 | Furukawa et al. | |
| 2012/0237395 | A1 | 9/2012 | Jarry | |
| 2013/0098208 | A1 | 4/2013 | Li et al. | |
| 2013/0156637 | A1 | 6/2013 | Park et al. | |
| 2015/0343526 | A1* | 12/2015 | Jelbert et al. | B22D 17/20 164/71.1 |

FOREIGN PATENT DOCUMENTS

| | | |
|---|---|---|
| CN | 20172337 | 1/2011 |
| CN | 101722288 | 6/2011 |
| EP | 0583124 | 9/1994 |
| EP | 0931607 | 12/1997 |
| EP | 1250972 | 10/2002 |
| FR | 1373768 | 8/1963 |
| FR | 2323988 | 2/1974 |
| GB | 1515933 | 10/1975 |
| JP | 6186058 | 5/1986 |
| JP | 62259644 | 11/1987 |
| JP | 62270252 | 11/1987 |
| JP | S63140744 | 6/1988 |
| JP | S63160752 | 7/1988 |
| JP | S63295061 | 12/1988 |
| JP | 0381047 | 4/1991 |
| JP | H062056 | 1/1994 |
| JP | H0741876 | 2/1995 |
| JP | H797681 | 4/1995 |
| JP | H1192514 | 4/1999 |
| JP | 2003326356 | 11/2003 |
| JP | 3555485 | 5/2004 |
| JP | 2006102807 | 4/2006 |
| JP | 2008200692 | 9/2008 |
| JP | 4551995 | 7/2010 |
| JP | 4594336 | 9/2010 |
| JP | 2010247179 | 11/2010 |
| JP | 4984049 | 5/2012 |
| JP | 5051636 | 8/2012 |
| KR | 100660223 | 12/2006 |
| WO | WO 03/033750 A1 | 4/2003 |
| WO | WO 2013/007891 | 1/2013 |

OTHER PUBLICATIONS

M. Qian et al., "Ultrasonic Grain Refinement of Magnesium and Its Alloys," Magnesium Alloys—Design, Processing and Properties, Frank Czerwinski (Ed.), pp. 169-186, Jan. 2011.

Bi Qui, et. al, *Effects of Ultrasonic Power on Solidification Structure in AZ31B Alloy Ingots* (2009). pp. 576-579 (with English Abstract).

Jeong Il Young & Young Jig Kim, *Nucleation Enhancement of Al Alloys by High Intensity Ultrasound*, Japanese Journal of Applied Physics 48, pp. 07GM14-1-07GM14-5 (2009).

Shulin Lü, et. al, *Microstructure and Tensile Properties of Wrough Al Alloy 5052 Produced by Rheo-Squeeze Casting*, Metallurgical and Materials Transactions A, vol. 44A, pp. 2735-2745 (2013).

Abramov, O.V., (1998), "High-Intensity Ultrasonics," Gordon and Breach Science Publishers, Amsterdam, The Netherlands, pp. 523-552.

Alcoa, (2000), "New Process for Grain Refinement of Aluminum," DOE Project Final Report, Contract No. DE-FC07-98ID13665, Sep. 22, 2000, pp. 1-267.

Cui, Y., Xu, C.L. And Han, Q., (2007), "Microstructure Improvement in Weld Metal Using Ultrasonic Vibrations, Advanced Engineering Materials," v. 9, No. 3, pp. 161-163.

Eskin, G.I., (1998), "Ultrasonic Treatment of Light Alloy Melts," Chapter 5: Continuous Casting of Light Alloys in the Ultrasonic Field; pp. 187-201; Gordon and Breach Science Publishers, Amsterdam, The Netherlands.

Eskin, G.I. (2002) "Effect of Ultrasonic Cavitation Treatment of the Melt on the Microstructure Evolution during Solidification of Aluminum Alloy Ingots," Zeitschrift Fur Metallkunde/Materials Research and Advanced Techniques, v.93, n. 6, Jun. 2002, pp. 502-507.

Greer, A.L., (2004), "Grain Refinement of Aluminum Alloys," in Chu, M.G., Granger, D.A., and Han, Q., (eds.), "Solidification of Aluminum Alloys," Proceedings of a Symposium Sponsored by TMS (The Minerals, Metals & Materials Society), TMS, Warrendale, PA 15086-7528, pp. 131-145.

Han, Q., (2007), The Use of Power Ultrasound for Material Processing, Han, Q., Ludtka, G., and Zhai, Q., (eds), (2007), "Materials Processing under the Influence of External Fields," Proceedings of a Symposium Sponsored by TMS (The Minerals, Metals & Materials Society), TMS, Warrendale, PA 15086-7528, pp. 97-106.

Jackson, K.A., Hunt, J.D., and Uhlmann, D.R and Seward, T.P., (1966), "On Origin of Equiaxed Zone in Castings," Trans. Metall. Soc. AIME, v. 236, pp. 149-158.

Jian, X., Xu, H., Meek, T.T., and Han, Q., (2005), "Effect of Power Ultrasoud on Solidification of Aluminum A356 Alloy," Materials Letters, v. 59, No. 2-3, pp. 190-193.

Keles, O. and Dundar, M., (2007). "Aluminum Foil: Its Typical Quality Problems and Their Causes," Journal of Materials Processing Technology, v. 186, pp. 125-137.

Liu, C., Pan, Y., and Aoyama, S., (1998),"Microstructure Evolution of Semi-Solid A1-7Si-0.4Mg Alloy by Short Time Supersonic

(56) References Cited

OTHER PUBLICATIONS

Vibrations" Proceedings of the 5th International Conference on Semi-Solid Processing of Alloys and Composites, Eds.: Bhasin, A.K., Moore, J.J., Young, K.P., and Madison, S., Colorado School of Mines, Golden, CO, pp. 439-447.

Megy, J., Granger, D.A., Sigworth, G.K., and Durst, C.R., (2000), "Effectiveness of In-Situ Aluminum Grain Refining Process," Light Metals, pp. 1-6.

Han et al., "Grain Refining of Pure Aluminum," Light Metals 2012, pp. 967-971.

H. Puga, et. al, Influence of Indirect Ultrasonic Vibration on the Microstructure and Mechanical Behavior of Al—Si—Cu Alloy, Material Sci.. & Eng'g A, Oct. 5, 2012, available at www.elsevier.com/locate/msea, pp. 589-595.

Titinan Methong & Bovornchok Poopat, The Effect of Ultrasonic Vibration on Properties of Weld Metal, Key Eng'g Materials, vol. 545, pp. 177-181 (2013).

Yuta Fukui, Yoshiki Tsunekawa & Masahiro Okumiya, Nucleation with Collapse of Acoustic Cavitation in Molten Al—Si Alloys, Advanced Materials Research, vols. 89-91, pp. 190-195 (2010).

* cited by examiner

At 670 °C

At 700 °C

At 730 °C

At 760 °C

At 680 °C

At 700 °C

At 730 °C

At 760 °C

ULTRASONIC GRAIN REFINING

CROSS-REFERENCE TO RELATED APPLICATIONS

This application claims the benefit of U.S. provisional application No. 62/113,882, filed Feb. 9, 2015, the entire contents of which is incorporated herein by reference.

STATEMENT REGARDING FEDERALLY SPONSORED RESEARCH OR DEVELOPMENT

This invention was made with government support under Grant No. IIP 1058494 awarded by the National Science Foundation. The government has certain rights in the invention.

BACKGROUND

1. Field

The present invention is related to a method for producing metal castings with controlled grain size, a system for producing the metal castings, and products obtained by the metal castings.

2. Description of the Related Art

Considerable effort has been expended in the metallurgical field to develop techniques for casting molten metal into continuous metal rod or cast products. Both batch casting and continuous castings are well developed. There are a number of advantages of continuous casting over batch castings although both are prominently used in the industry.

In the continuous production of metal cast, molten metal passes from a holding furnace into a series of launders and into the mold of a casting wheel where it is cast into a metal bar. The solidified metal bar is removed from the casting wheel and directed into a rolling mill where it is rolled into continuous rod. Depending upon the intended end use of the metal rod product and alloy, the rod may be subjected to cooling during rolling or the rod may be cooled or quenched immediately upon exiting from the rolling mill to impart thereto the desired mechanical and physical properties. Techniques such as those described in U.S. Pat. No. 3,395,560 to Cofer et al. (the entire contents of which are incorporated herein by reference) have been used to continuously-process a metal rod or bar product.

U.S. Pat. No. 3,938,991 to Jackson et al. (the entire contents of which are incorporated herein by reference) shows that there has been a long recognized problem with casting of "pure" metal products. By "pure" metal castings, this term refers to a metal or a metal alloy formed of the primary metallic elements designed for a particular conductivity or tensile strength or ductility without inclusion of separate impurities added for the purpose of grain control.

Grain refining is a process by which the crystal size of the newly formed phase is reduced by either chemical or physical/mechanical means. Grain refiners are usually added into molten metal to significantly reduce the grain size of the solidified structure during the solidification process or the liquid to solid phase transition process.

Indeed, a WIPO Patent Application WO/2003/033750 to Boily et al. (the entire contents of which are incorporated herein by reference) describes the specific use of "grain refiners." The '750 application describes in their background section that, in the aluminum industry, different grain refiners are generally incorporated in the aluminum to form a master alloy. A typical master alloys for use in aluminum casting comprise from 1 to 10% titanium and from 0.1 to 5% boron or carbon, the balance consisting essentially of aluminum or magnesium, with particles of $TiB_2$ or TiC being dispersed throughout the matrix of aluminum. According to the '750 application, master alloys containing titanium and boron can be produced by dissolving the required quantities of titanium and boron in an aluminum melt. This is achieved by reacting molten aluminum with $KBF_4$ and $K_2TiF_6$ at temperatures in excess of 800° C. These complex halide salts react quickly with molten aluminum and provide titanium and boron to the melt.

The '750 application also describes that, as of 2002, this technique was used to produce commercial master alloys by almost all grain refiner manufacturing companies. Grain refiners frequently referred to as nucleating agents are still used today. For example, one commercial suppliers of a TIBOR master alloy describes that the close control of the cast structure is a major requirement in the production of high quality aluminum alloy products.

Prior to this invention, grain refiners were recognized as the most effective way to provide a fine and uniform as-cast grain structure. The following references (all the contents of which are incorporated herein by reference) provide details of this background work:

Abramov, O. V., (1998), "*High-Intensity Ultrasonics*," Gordon and Breach Science Publishers, Amsterdam, the Netherlands, pp. 523-552.

Alcoa, (2000), "*New Process for Grain Refinement of Aluminum*," DOE Project Final Report, Contract No. DE-FC07-98ID13665, Sep. 22, 2000.

Cui, Y., Xu, C. L. and Han, Q., (2007), "*Microstructure Improvement in Weld Metal Using Ultrasonic Vibrations, Advanced Engineering Materials*," v. 9, No. 3, pp. 161-163.

Eskin, G. I., (1998), "*Ultrasonic Treatment of Light Alloy Melts*," Gordon and Breach Science Publishers, Amsterdam, The Netherlands.

Eskin, G. I. (2002) "*Effect of Ultrasonic Cavitation Treatment of the Melt on the Microstructure Evolution during Solidification of Aluminum Alloy Ingots*," Zeitschrift Fur Metallkunde/Materials Research and Advanced Techniques, v. 93, n.6, June, 2002, pp. 502-507.

Greer, A. L., (2004), "*Grain Refinement of Aluminum Alloys*," in Chu, M. G., Granger, D. A., and Han, Q., (eds.), "*Solidification of Aluminum Alloys*," Proceedings of a Symposium Sponsored by TMS (The Minerals, Metals & Materials Society), TMS, Warrendale, Pa. 15086-7528, pp. 131-145.

Han, Q., (2007), *The Use of Power Ultrasound for Material Processing*," Han, Q., Ludtka, G., and Zhai, Q., (eds), (2007), "*Materials Processing under the Influence of External Fields*," Proceedings of a Symposium Sponsored by TMS (The Minerals, Metals & Materials Society), TMS, Warrendale, Pa. 15086-7528, pp. 97-106.

Jackson, K. A., Hunt, I. D., and Uhlmann, D. R., and Seward, T. P., (1966), "*On Origin of Equiaxed Zone in Castings*," Trans. Metall. Soc. AIME, v. 236, pp. 149-158.

Jian, X., Xu, H., Meek, T. T., and Tian, Q., (2005), "*Effect of Power Ultrasound on Solidification of Aluminum A356 Alloy*," Materials Letters, v. 59, no. 2-3, pp. 190-193.

Keles, O. and Dundar, M., (2007). "*Aluminum Foil: Its Typical Quality Problems and Their Causes*," Journal of Materials Processing Technology, v. 186, pp. 125-137.

Liu, C., Pan, Y, and Aoyama, S., (1998), *Proceedings of the 5th International Conference on Semi-Solid Processing of Alloys and Composites*, Eds.: Bhasin, A. K., Moore, J. J., Young, K. P., and Madison, S., Colorado School of Mines, Golden, Colo., pp. 439-447.

Megy, J., (1999), "*Molten Metal Treatment*," U.S. Pat. No. 5,935,295, August, 1999

Megy, J., Granger, D. A., Sigworth, G. K., and Durst, C. R., (2000), "*Effectiveness of In-Situ Aluminum Grain Refining Process*," Light Metals, pp. 1-6.

Cui et al., "*Microstructure Improvement in Weld Metal Using Ultrasonic Vibrations*," Advanced Engineering Materials, 2007, vol. 9, no. 3, pp. 161-163.

Han et al., "*Grain Refining of Pure Aluminum*," Light Metals 2012, pp. 967-971.

SUMMARY

In one embodiment of the present invention, there is provided a molten metal processing device including a molten metal containment structure for reception and transport of molten metal along a longitudinal length thereof. The device further includes a cooling unit for the containment structure including a cooling channel for passage of a liquid medium therein, and an ultrasonic probe disposed in relation to the cooling channel such that ultrasonic waves are coupled through the liquid medium in the cooling channel and through the molten metal containment structure into the molten metal.

In one embodiment of the present invention, there is provided a method for forming a metal product. The method transports molten metal along a longitudinal length of a molten metal containment structure. The method cools the molten metal containment structure by passage of a medium through a cooling channel thermally coupled to the molten metal containment structure, and couples ultrasonic waves through the medium in the cooling channel and through the molten metal containment structure into the molten metal.

In one embodiment of the present invention, there is provided a system for forming a metal product. The system includes 1) the molten metal processing device described above and 2) a controller including data inputs and control outputs, and programmed with control algorithms which permit operation of the above-described method steps.

In one embodiment of the present invention, there is provided a metallic product including a cast metallic composition having sub-millimeter grain sizes and including less than 0.5% grain refiners therein.

It is to be understood that both the foregoing general description of the invention and the following detailed description are exemplary, but are not restrictive of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1A:
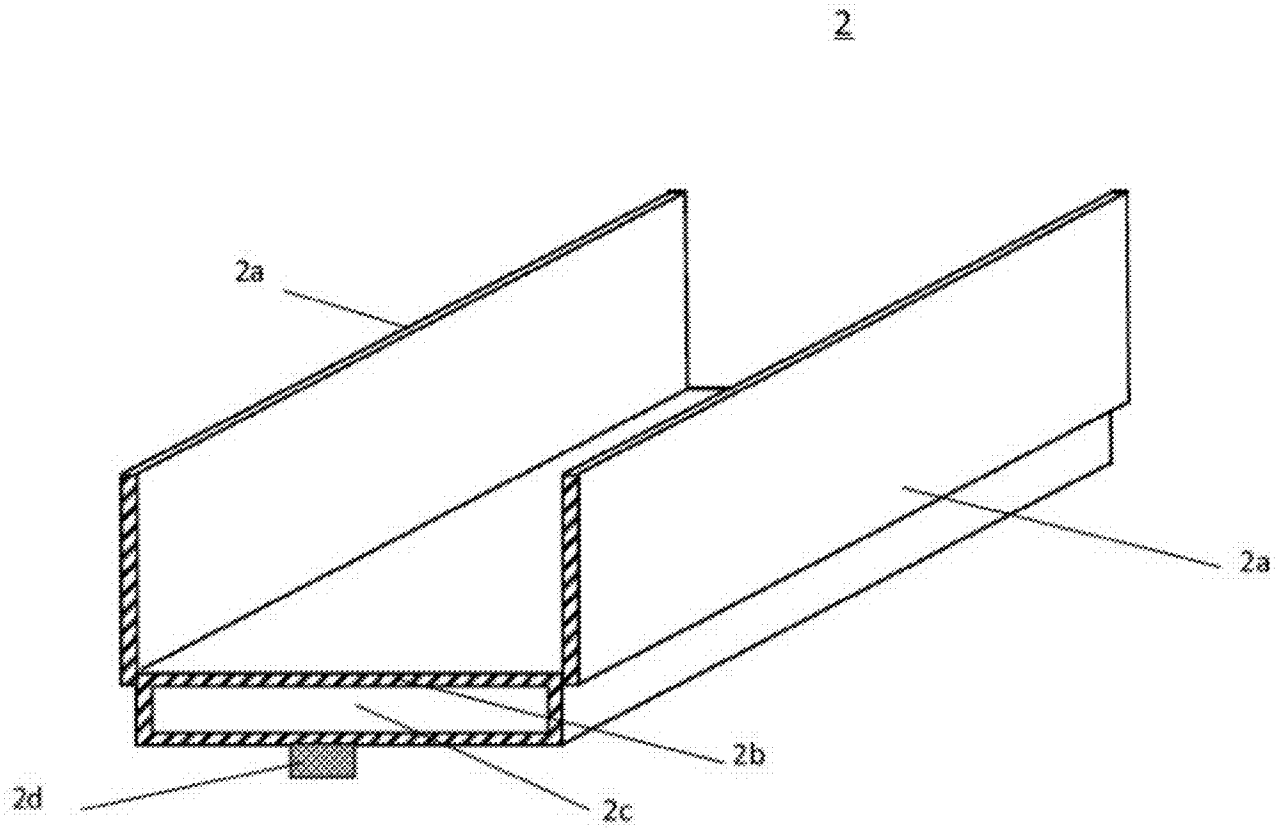
FIG. 1A is a schematic of a casting channel according to one embodiment of the invention.

Grain refining of metals and alloys is important for many reasons, including maximizing ingot casting rate, improving resistance to hot tearing, minimizing elemental segregation, enhancing mechanical properties, particularly ductility, improving the finishing characteristics of wrought products and increasing the mold filling characteristics, and decreasing the porosity of foundry alloys. Usually grain refining is one of the first processing steps for the production of metal and alloy products, especially aluminum alloys and magnesium alloys, which are two of the lightweight materials used increasingly in the aerospace, defense, automotive, construction, and packaging industry. Grain refining is also an important processing step for making metals and alloys castable by eliminating columnar grains and forming equiaxed grains. Yet, prior to this invention, use of impurities or chemical "grain refiners" was the only way to address the long recognized problem in the metal casting industry of columnar grain formation in metal castings.

Approximately 68% of the aluminum produced in the United States is first cast into ingot prior to further processing into sheets, plates, extrusions, or foil. The direct chill (DC) semi-continuous casting process and continuous casting (CC) process have been the mainstay of the aluminum industry due largely to its robust nature and relative simplicity. One issue with the DC and CC processes is the hot tearing formation or cracking formation during ingot solidification. Basically all ingots would be cracked (or not castable) without using grain refining.

Still, the production rates of these modern processes are limited by the conditions to avoid cracking formation. Grain refining is an effective way to reduce the hot tearing tendency of an alloy and thus to increase the production rates. As a result, a significant amount of effort has been concentrated on the development of powerful grain refiners that can produce grain sizes as small as possible. Superplasticity can be achieved if the grain size can be reduced to the sub-micron level, which permits alloys not only to be cast at much faster rates but also rolled/extruded at lower temperatures at much faster rates than ingots are processed today, leading to significant cost savings and energy savings.

At present nearly all aluminum cast in the world either from primary (approximately 20 billion kg) or secondary and internal scrap (25 billion kg) are grain refined with heterogeneous nuclei of insoluble $TiB_2$ nuclei approximately a few microns in diameter, which nucleate a fine grain structure in aluminum. One issue related to the use of chemical grain refiners is the limited grain refining capability. Further, the use of chemical grain refiners causes a limited decrease in aluminum grain size, from a columnar structure with linear grain dimensions of something over 2,500 μm, to equiaxed grains of less than 200 μm. Equiaxed grains of 100 μm in aluminum alloys appear to be the limit that can be obtained using the chemical grain refiners commercially available.

It is widely recognized that the productivity can be significantly increased if the grain size can be further reduced. Grain size in the sub-micron level leads to superplasticity that makes forming of aluminum alloys much easier at room temperatures.

Another issue related to the use of chemical grain refiners is the defect formation associated with the use of grain refiners. Although considered in the prior art to be necessary for grain refining, the insoluble, foreign particles are otherwise undesirable in aluminum, particularly in the form of particle agglomerates ("clusters"). The current grain refiners, which are present in the form of compounds in aluminum base master alloys, are produced by a complicated string of mining, beneficiation, and manufacturing processes. The master alloys used now frequently contain potassium aluminum fluoride (KAlF) salt and aluminum oxide impurities (dross) which arise from the conventional manufacturing process of aluminum grain refiners. These give rise to local defects in aluminum (e.g. "leakers" in beverage cans and "pin holes" in thin foil), machine tool abrasion, and surface finish problems in aluminum. Data from one of the aluminum cable company indicated that 25% of the production defects is due to $TiB_2$ particle agglomerates, and another 25% of defects is due to dross that are entrapped into aluminum during the casting process. $TiB_2$ particle agglomerates often break the wires during extrusion, especially when the diameter of the wires is smaller than 8 mm.

Another issue related to the use of chemical grain refiners is the cost of the grain refiners. This is extremely true for the production of magnesium ingots using Zr grain refiners. Grain refining using Zr grain refiners costs about an extra $1 per kilogram of Mg casting produced. Grain refiners for aluminum alloys cost around $1.50 per kilogram.

Another issue related to the use of chemical grain refiners is the reduced electrical conductivity. The use of chemical grain refiners introduces in excess amount of Ti in aluminum, causes a substantial decrease in electrical conductivity of pure aluminum for cable applications. In order to maintain certain conductivity, companies have to pay extra money to use purer aluminum for making cables and wires.

A number of other grain refining methods, in addition to the chemical methods, have been explored in the past century. These methods include using physical fields, such as magnetic and electro-magnetic fields, and using mechanical vibrations. High-intensity, low-amplitude ultrasonic vibration is one of the physical/mechanical mechanisms that has been demonstrated for grain refining of metals and alloys without using foreign particles. However, experimental results, such as from Cui et al, 2007 noted above, were obtained in small ingots up to a few pounds of metal subjected to a short period of time of ultrasonic vibration. Little effort has been carried out on grain refining of CC or DC casting ingots/billets using high-intensity ultrasonic vibrations.

The technical challenges addressed in the present invention for grain refining are (1) the coupling of ultrasonic energy to the molten metal for extended times, (2) maintaining the natural vibration frequencies of the system at elevated temperatures, and (3) increasing the grain refining efficiency of ultrasonic grain refining when the temperature of the ultrasonic wave guide is hot. Enhanced cooling for both the ultrasonic wave guide and the ingot (as described below) is one of the solutions presented here for addressing these challenges.

Moreover, another technical challenge addressed in the present invention relates to the fact that, the purer the aluminum, the harder it is to obtain equiaxed grains during the solidification process. Even with the use of external grain refiners such as TiB (Titanium boride) in pure aluminum such as 1000, 1100 and 1300 series of aluminum, it remains difficult to obtain an equiaxed grain structure. However, using the novel grain refining technology described herein, an equiaxed grains structure has been obtained.

The present invention suppresses the problem of columnar grain formation without the necessity of introducing grain refiners. The inventors have surprisingly discovered that the use of controlled application of ultrasonic vibrations to the molten metal as it is being poured into the casting permits the realization of grain sizes comparable to or smaller than that obtained with state of the art grain refiners such as the TIBOR master alloy.

In one aspect of the invention, equiaxed grains within the cast product is obtained without the necessity of adding impurity particles, such as titanium boride, into the metal or metallic alloy to increase the number of grains and improve uniform heterogeneous solidification. Instead of using the nucleating agents, ultrasonic vibrations can be used to create nucleating sites. Specifically, as explained in more detail below, ultrasonic vibrations are coupled with a liquid medium to refine the grains in metals and metallic alloys, and create equiaxed grains.

To understand the morphology of an equiaxed grain consider conventional metal grain growth in which dendrites grow one dimensionally and elongated grains are formed. These elongated grains are referred to as columnar grains. If a grain grows freely in all directions, an equiaxed grain is formed. Each equiaxed grain contains 6 primary dendrites growing perpendicularly. These dendrites may grow at identical rate. In which case, the grains appear more spherical, if ignoring the detailed dendritic features within the grain.

In one embodiment of the present invention, a channel structure 2 (i.e. a molten metal containment structure) as shown in FIG. 1A transports molten metal to a casting mold (not shown in FIG. 1A) such as for example the casting wheel detailed below. The channel structure 2 includes side walls 2*a* containing the molten metal and a bottom plate 2*b*. The side walls 2*a* and the bottom plate 2*b* can be separate entities as shown or can be an integrated unit. Beneath the bottom plate 2*b* is a liquid medium passage 2*c* (i.e., a cooling channel) which in operation is filled with a liquid cooling medium. Furthermore, these two elements may be integral as in a cast object.

Disposed coupled to the liquid medium passage 2*c* is a ultrasonic wave probe 2*d* (or sonotrode, or ultrasonic radiator) of an ultrasonic transducer that provides ultrasonic vibrations (UV) through the liquid medium and through the bottom plate 2*b* into the liquid metal. In one embodiment of the invention, the ultrasonic wave probe 2*d* is inserted into the liquid medium passage 2*c*. In one embodiment of the invention, more than one ultrasonic wave probe or an array of ultrasonic wave probes can be inserted into the liquid medium passage 2*c*. In one embodiment of the invention, the ultrasonic wave probe 2*d* is attached to a wall of the liquid medium passage 2*c*. While not bound to any particular theory, a relatively small amount of undercooling (e.g., less than 10° C.) at the bottom of the channel results in a layer of small nuclei of purer aluminum being formed. The ultrasonic vibrations from the bottom of the channel creates these pure aluminum nuclei which then are used as nucleating agents during solidification resulting in a uniform grain structure. Accordingly, in one embodiment of the invention, the cooling method ensures that a small amount of undercooling at the bottom of the channel results in a layer of small nuclei of aluminum. The ultrasonic vibrations from the bottom of the channel disperse these nuclei and breaks up dendrites that forms in the undercooled layer. These aluminum nuclei and fragments of dendrites are then used to form equiaxed grains in the mold during solidification resulting in a uniform grain structure.

In other words, ultrasonic vibrations transmitted through the bottom plate 2*b* and into the liquid metal create nucleation sites in the metals or metallic alloys to refine the grain size. The bottom plate can be a refractory metal or other high temperature material such as copper, irons and steels, niobium, niobium and molybdenum, tantalum, tungsten, and rhenium, and alloys thereof including one or more elements such as silicon, oxygen, or nitrogen which can extend the melting points of these materials. Furthermore, the bottom plate can be one of a number of steel alloys such as for example low carbon steels or H13 steel.

In one embodiment of the present invention, there is provided a wall between the molten metal and the cooling unit in which the thickness of the wall is thin enough (as detailed below in the examples) so that, under steady-state production, the molten metal adjacent to this wall will be cooled below critical temperatures for the particular metal being cast.

In one of the embodiment of the present invention, the ultrasonic vibration system is used to enhance heat transfer through the thin wall between the cooling channel and the molten metal and to induce nucleation or to break up dendrites that forms in the molten metal adjacent to the thin wall of the cooling channel.

In the demonstrations below, the source of ultrasonic vibrations provided a power of 1.5 kW at an acoustic frequency of 20 kHz. This invention is not restricted to those powers and frequencies. Rather, a broad range of powers and frequencies can be used although the following ranges are of interest.

Power: In general, powers between 50 and 5000 W for each sonotrode, depending on the dimensions of the sonotrode or probe. These powers are typically applied to the sonotrode to ensure that the power density at the end of the sonotrode is higher than 100 W/cm$^2$, which is the threshold for causing cavitation in molten metals. The powers at this area can range from 50 to 5000 W, 100 to 3000 W, 500 to 2000 W, 1000 to 1500 W or any intermediate or overlapping range. Higher powers for larger probe/sonotrode and lower powers for smaller probe are possible.

Frequency: In general, 5 to 400 kHz (or any intermediate range) may be used. Alternatively, 10 and 30 kHz (or any intermediate range) may be used. Alternatively, 15 and 25 kHz (or any intermediate range) may be used. The frequency applied can range from 5 to 400 KHz, 10 to 30 kHz, 15 to 25 kHz, 10 to 200 KHz, or 50 to 100 kHz or any intermediate or overlapping range.

Moreover, the ultrasonic probe/sonotrode 2*d* can be constructed similar to the ultrasonic probes used for molten metal degassing as described in U.S. Pat. No. 8,574,336 (the entire contents of which are incorporated herein by reference).

In FIG. 1A, the dimensions of the channel structure 2 are selected according to the volumetric flow of material to be cast. The dimensions of the liquid medium passage 2*c* are selected in accordance with a flow rate of the cooling medium through the channel to insure that the cooling medium remains substantially in liquid phase. The liquid medium may be water. The liquid medium may also be oil, ionic liquids, liquid metals, liquid polymers, or other mineral (inorganic) liquids. The development of steam for example in the cooling passage may degrade coupling of the ultrasonic waves into the molten metal being processed. The thickness and material construction of the bottom plate 2*b* is selected according to the temperature of the molten metal, the temperature gradient though the thickness of the bottom plate, and nature of the underlying wall of the liquid medium passage 2*c*. More details regarding the thermal considerations are provided below.

Figure 1B:
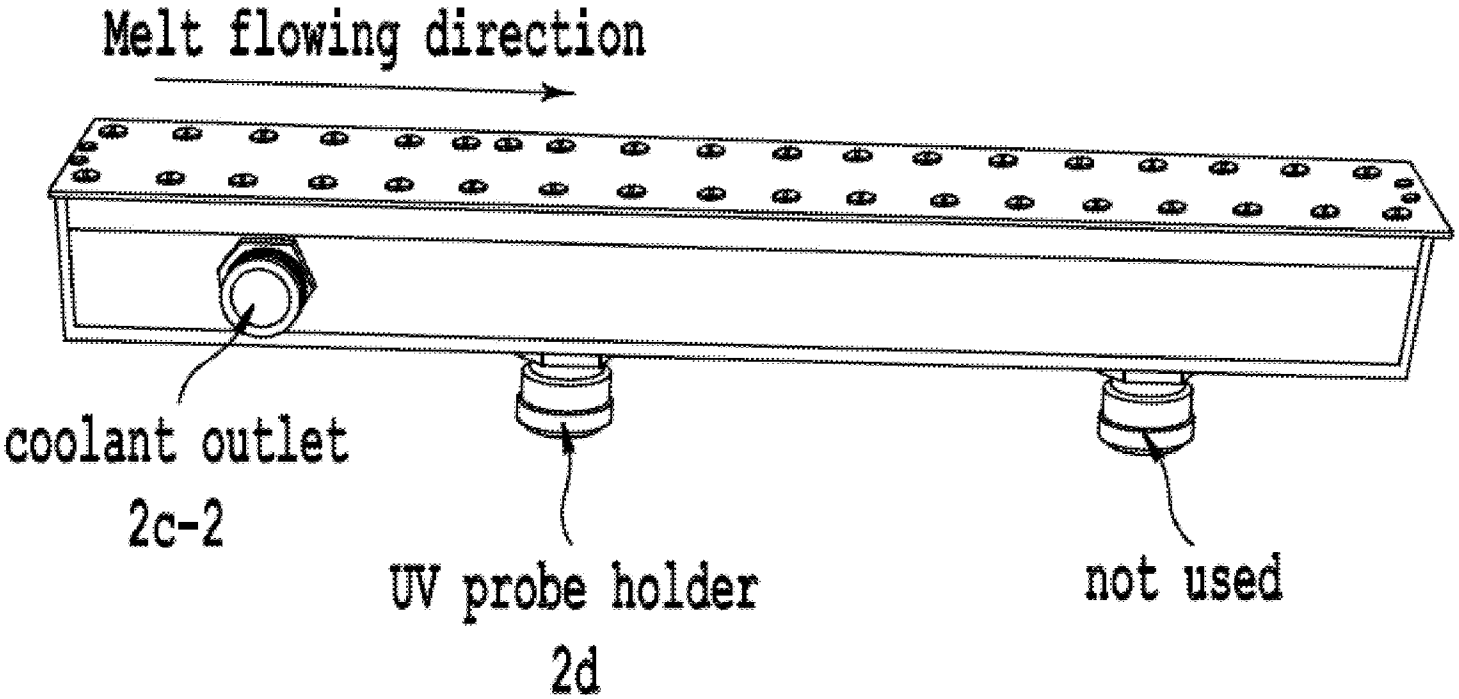
FIG. 1B is a schematic depiction of the base of a casting channel according to one embodiment of the invention.
Figure 1C:
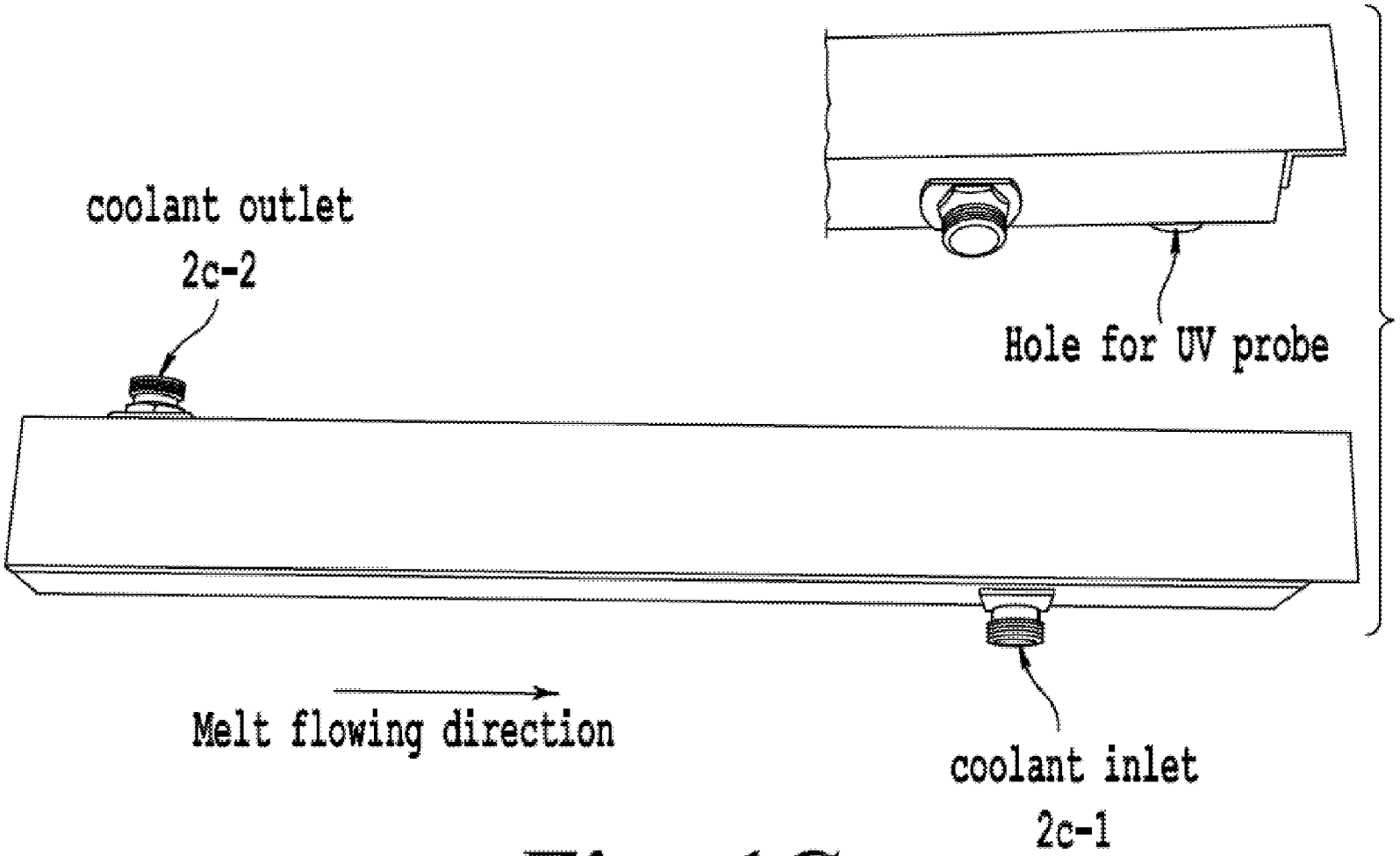
FIG. 1C is a composite schematic depiction of the base of a casting channel according to one embodiment of the invention.
Figure 1D:
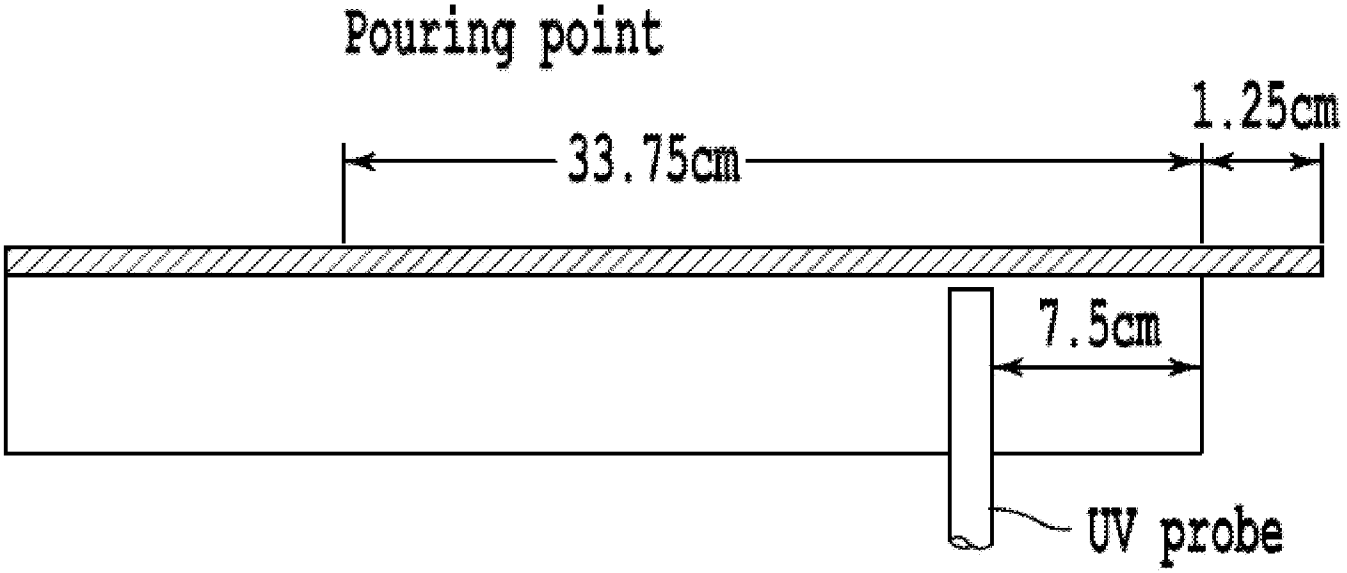
FIG. 1D is a schematic depiction of illustrative dimensions for one embodiment of a casting channel.

FIGS. 1B and 1C are perspective views of the channel structure 2 (without the sidewalls 2*a*) showing the bottom plate 2*b*, liquid medium passage inlet 2*c*-1, liquid medium passage exit 2*c*-2, and ultrasonic wave probe 2*d*. FIG. 1D shows the dimensions associated with the channel structure 2 depicted in FIGS. 1B and 1C.

During operation, molten metal at a temperature substantially higher than the liquidus temperature of the alloy flows by gravity along the top of the bottom plate 2*b* and it exposed to ultrasonic vibrations as it transits the channel structure 2. The bottom plate is cooled to ensure that the molten metal adjacent to the bottom plate is close to the sub-liquidus temperature (e.g., less than 5 to 10° C. above the liquidus temperature of the alloy or even lower than the liquidus temperature, although the pouring temperature can be much higher than 10° C. in our experimental results). The temperature of the bottom plate can be controlled if needed by either using the liquid in the channel or by using auxiliary heaters. During operation, the atmosphere about the molten metal may be controlled by way of a shroud (not shown) which is filled or purged for example with an inert gas such as Ar, He, or nitrogen. The molten metal flowing down the channel structure 2 is typically in a state of thermal arrest in which the molten metal is converting from a liquid to a solid. The molten metal flowing down the channel structure 2 exits an end of the channel structure 2 and pours into a mold such as mold 3 shown in FIG. 2. Mold 3 has a wall 3*a* made of a relatively high temperature material such as copper or steel partially enclosing a cavity region 3*b*. The mold 3 can have a lid 3*c*. The mold shown in FIG. 2 can hold about 5 kg of an aluminum melt. The present invention is not restricted to this weight capacity. The mold is not restricted to the shape shown in FIG. 2. In an alternative example, a copper mold sized to produce approximately 7.5 cm diameter and 6.35 cm tall conical shaped ingots has been used. Other sizes, shapes, and materials can be used for the mold. The mold can be stationary or moving.

The mold 3 can have attributes of the molds described in U.S. Pat. No. 4,211,271 (the entire contents of which are incorporated herein by reference) used for wheel-band type continuous metal casting machines. In particular, as described therein and applicable as an embodiment of this invention, a corner filling device or material is used in combination with the mold members such as the wheel and band to modify the mold geometry no as to prevent corner cracking due to the solidification stresses present in other mold shapes having sharp or square edges. Ablative, conductive, or insulating materials, selected in accordance with the desired change in solidification pattern, may be introduced into the mold either separate from, or attached to the moving mold members such as the endless band or the casting wheel.

In one mode of operation, a water pump (not shown) pumps water into the channel structure 2, and the water exiting channel structure 2 sprays the outside of the molten metal containment 3. In other modes of operation, separate cooling supplies are used to cool the channel structure 2 and the molten metal containment 3. In other modes of operation, fluids other than water can be used for the cooling medium. In the mold, the metal cools forming a solidified body, typically shrinking in volume and releasing from the side walls of the mold.

Figure 2:
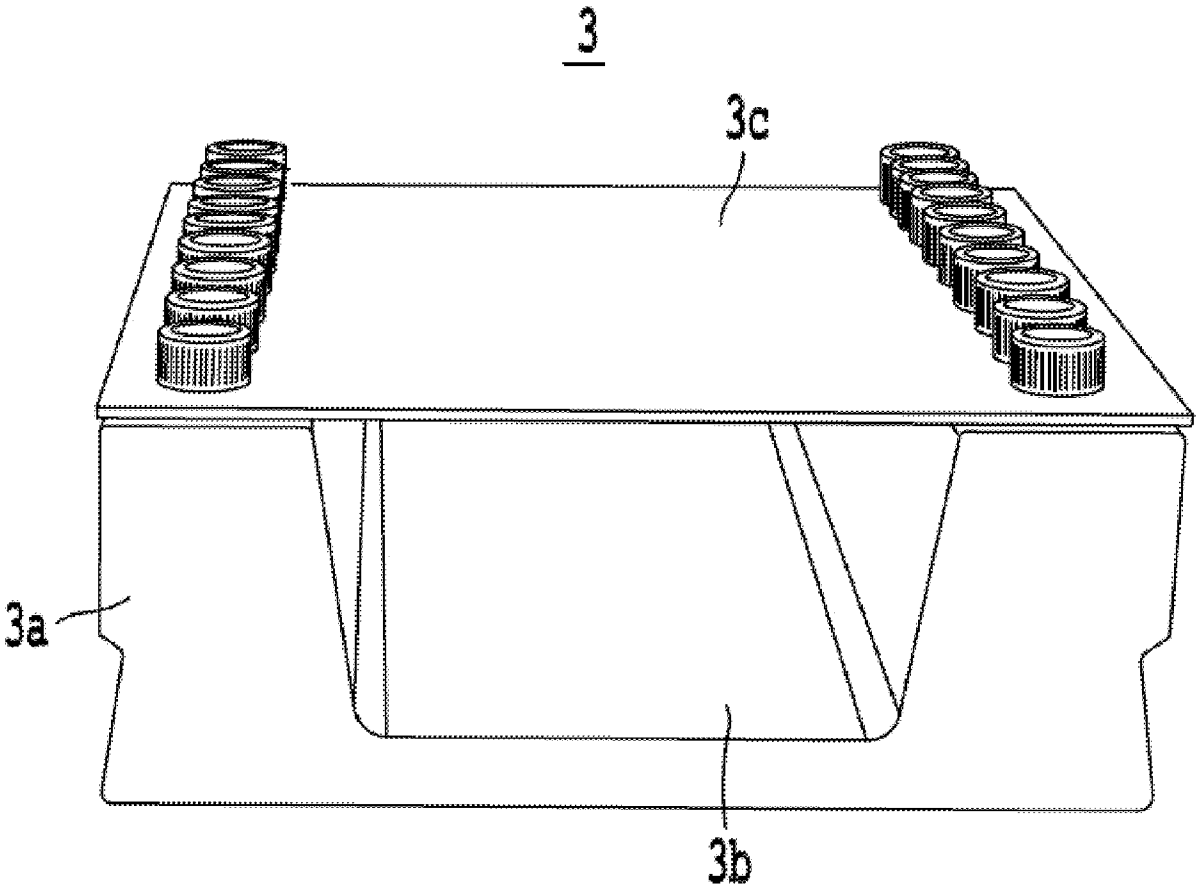
FIG. 2 is a schematic depiction of a mold according to one embodiment of the invention.

While not shown in FIG. 2, in a continuous casting process, mold 3 would be a part of a rotating wheel, and the molten metal would fill the mold 3 by entrance through an exposed end. Such a continuous casting process is described in U.S. Pat. No. 4,066,475 to Chis et al. (the entire contents of which are incorporated herein by reference). For example, in one aspect of the present invention and with reference to FIG. 3A, the steps of continuously casting can be carried out in the apparatus shown therein. The apparatus includes a delivery device 10 which receives molten copper metal containing normal impurities and delivers the metal to a pouring spout 11. The pouring spout would include as a separate attachment (or would have integrated therewith the components of) the channel structure 2 shown in FIGS. 1A-1B (or other channel structures described elsewhere in this specification) in order to provide the ultrasonic treatment to the molten metal to induce nucleation sites.

The pouring spout 11 directs the molten metal to a peripheral groove contained on a rotary mold ring 13 (e.g., mold 3 shown in FIG. 2 without lid 3*c*). An endless flexible metal band 14 encircles both a portion of the mold ring 13 as well as a portion of a set of band-positioning rollers 15 such that a continuous casting mold is defined by the groove in the mold ring 13 and the overlying metal band 14. A cooling system is provided for cooling the apparatus and effecting controlled solidification of the molten metal during its transport on the rotary mold ring 13. The cooling system includes a plurality of side headers 17, 18, and 19 disposed on the side of the mold ring 13 and inner and outer band headers 20 and 21, respectively, disposed on the inner and outer sides of the metal band 14 at a location where it encircles the mold ring. A conduit network 24 having suitable valving is connected to supply and exhaust coolant to the various headers so as to control the cooling of the apparatus and the rate of solidification of the molten metal. For a more detailed showing and explanation of this type of apparatus, reference may be had to U.S. Pat. No. 3,596,702 to Ward et al, (the entire contents of which are incorporated herein by reference).

Figure 3A:
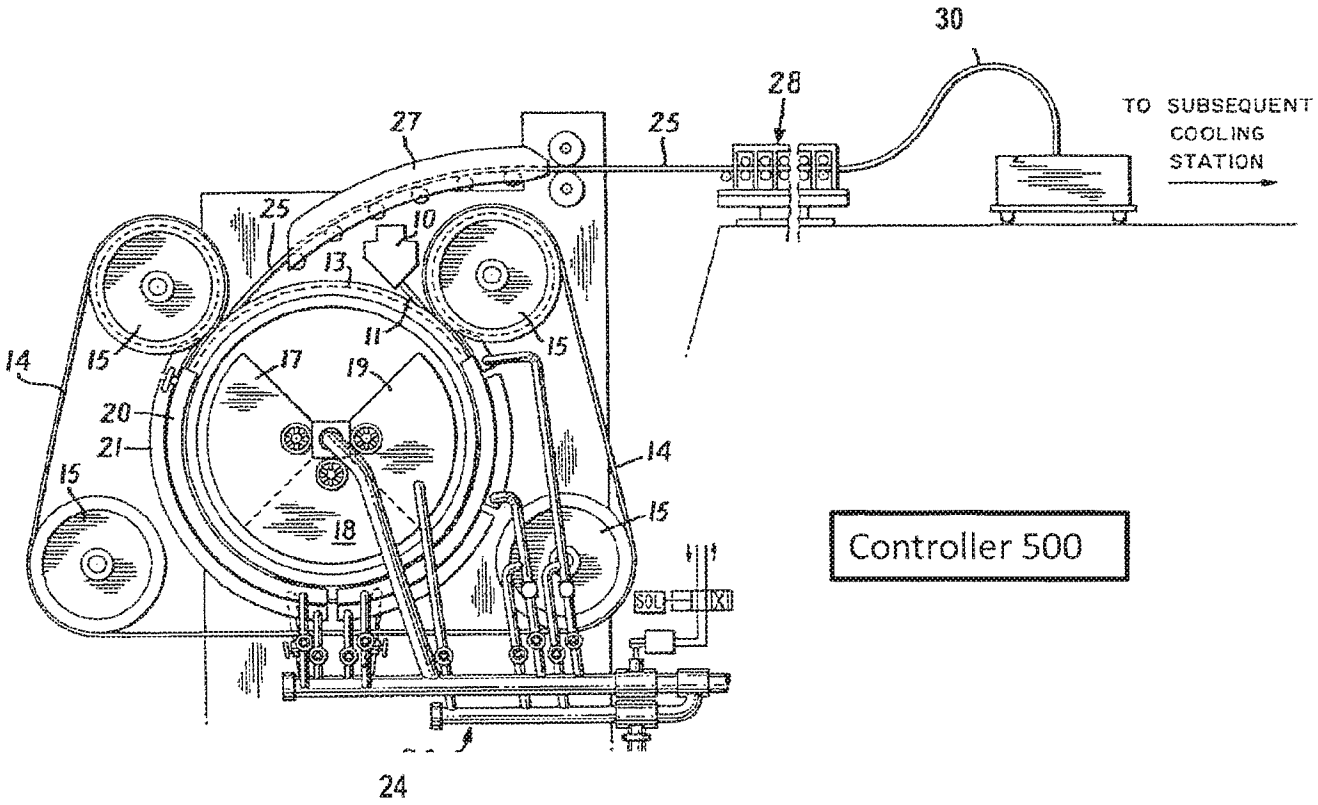
FIG. 3A is a schematic of a continuous casting mill according to one embodiment of the invention.

FIG. 3A also shows controller 500 which controls the various parts of the continuous aluminum casting system shown therein. As discussed in detail below, controller 500 includes one or more processors with programmed instructions to control the operation of the continuously casting system depicted in FIG. 3A.

By such a construction, molten metal is fed from the pouring spout 11 into the casting mold at the point A and is solidified and partially cooled during its transport between the points A and B by circulation of coolant through the cooling system. Thus, by the time the cast bar reaches the point B, it is in the form of a solid cast bar 25. The solid cast bar 25 is withdrawn from the casting wheel and fed to a conveyor 27 which conveys the cast bar to a rolling mill 28. It should be noted that at the point B, the cast bar 25 has only been cooled an amount sufficient to solidify the bar and the bar remains at an elevated temperature to allow an immediate rolling operation to be performed thereon. The rolling mill 28 can include a tandem array of rolling stands which successively roll the bar into a continuous length of wire rod 30 which has a substantially uniform, circular cross-section.

Figure 3B:
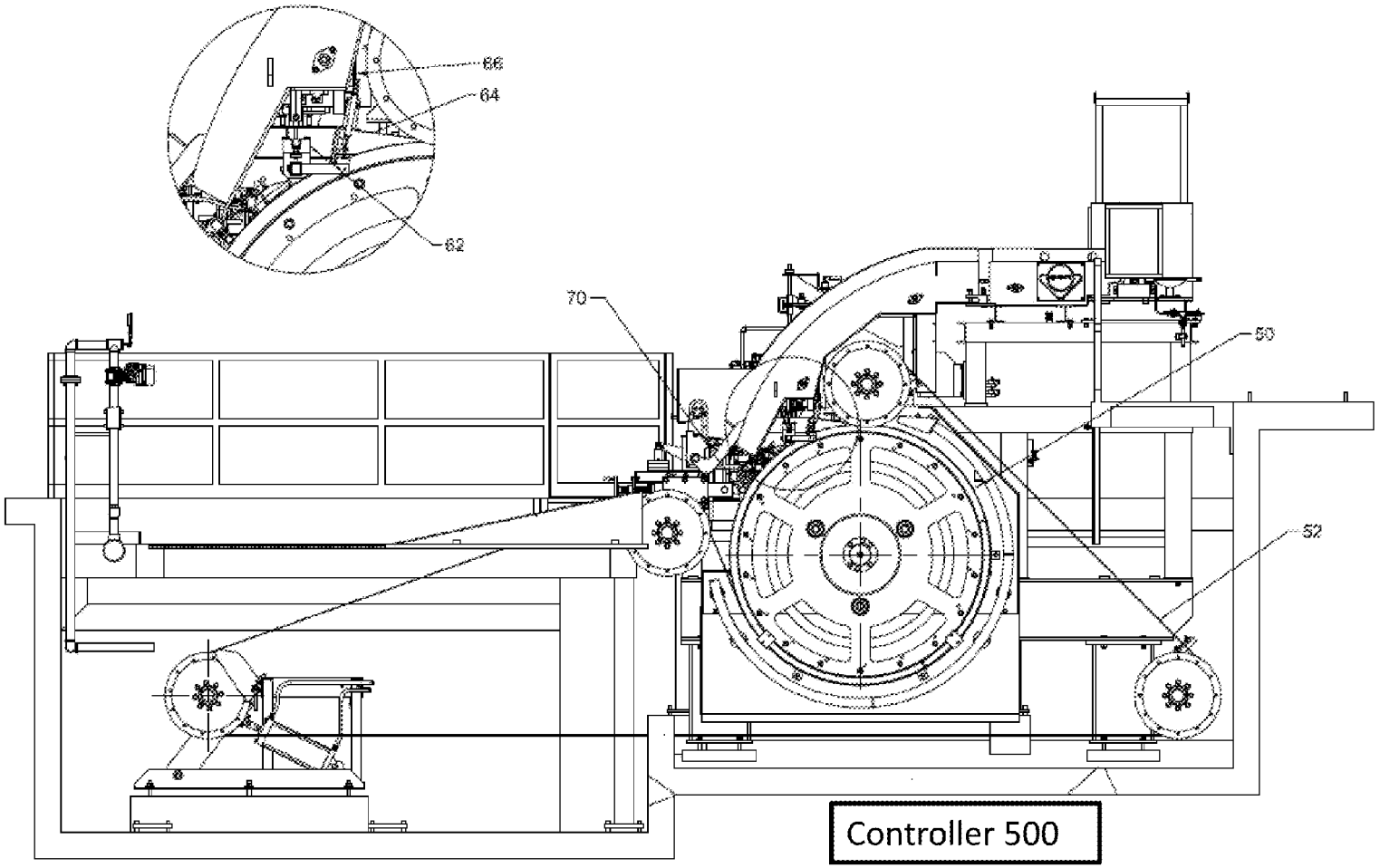
FIG. 3B is a schematic of another continuous casting mill according to one embodiment of the invention.

FIG. 3B is a schematic of another continuous casting mill according to one embodiment of the invention. FIG. 3B provides an overall view of a continuous rod (CR) system and has an inset showing an expanded view about the pouring spout. The CR system shown in FIG. 3B is characterized as a wheel and belt casting system, which has a water cooled copper casting wheel 50 and a flexible steel band 52. In one embodiment of the invention, the casting wheel 50 has a groove (not apparent from the view provided) in the outer periphery of the casting wheel, and the flexible steel band 52 goes approximately half way around the casting wheel 50 to enclose the casting groove. In one embodiment of the invention, the casting groove and the flexible steel band that encloses the casting groove form a mold cavity. In one embodiment of the invention, a tundish 62, a pouring spout 64, and a metering device 66 deliver molten aluminum into the casting groove as the wheel 50 rotates. In one embodiment of the invention, a parting agent/mold coating is applied to the wheel and steel band just before the pouring point. The molten metal is typically held in place by the steel band 52 until completion of the solidification process. As the wheel turns, the aluminum (or the poured metal) solidifies. The solidified aluminum, with the help of a stripper shoe 70, exits the wheel 50. The wheel 50 is then wiped, and the de-molding agent is reapplied prior to the introduction of fresh molten aluminum.

In the CR system of FIG. 3B, the pouring spout would include as a separate attachment (or would have integrated therewith the components of) the channel structure 2 shown in FIGS. 1A-1B (or other channel structures described elsewhere in this specification) in order to provide the ultrasonic treatment to the molten metal to induce nucleation sites.

FIG. 3B also shows controller 500 which (as above) controls the various parts of the continuous aluminum casting system shown therein. Controller 500 includes one or more processors with programmed instructions to control the operation of the continuously casting system depicted in FIG. 3B.

As noted above, the mold can be stationary as would be used in sand casting, plaster mold casting, shell molding, investment casting, permanent mold casting, die casting, etc. While described below with respect to aluminum, this invention is not so limited and other metals such as copper, silver, gold, magnesium, bronze, brass, tin, steels, irons, and alloys thereof can utilize the principles of this invention. Additionally, metal-matrix composites can utilize the principles of this invention to control the resultant grain sizes in the cast objects.

Demonstrations:

The following demonstrations show the utility of the present invention and are not intended to limit the present invention to any of the specific dimensions, cooling conditions, production rates, and temperatures set forth below unless such specification is used in the claims.

Using the channel structures shown in FIGS. 1A-1D and the mold in FIG. 2, results of the invention were documented. Except as noted below, the channel structures had bottom plates 2*b* approximately 5 cm wide and 54 cm long making for a vibratory path of about 52 cm (i.e., approximately the length of the liquid cooling channel 2*c*). The thickness of the bottom plate varied as noted below but for a steel bottom plate the thickness was 6.35 mm. The steel alloy used here was 1010 steel. The height and width of the liquid cooling channel 2*c* was approximately 2 cm and 4.5 cm, respectively. The cooling fluid was water supplied at near room temperature and flowing at approximately 22-25 liters/min.

1) Without Grain Refiners and Without Ultrasonic Vibration

Figure 4A:
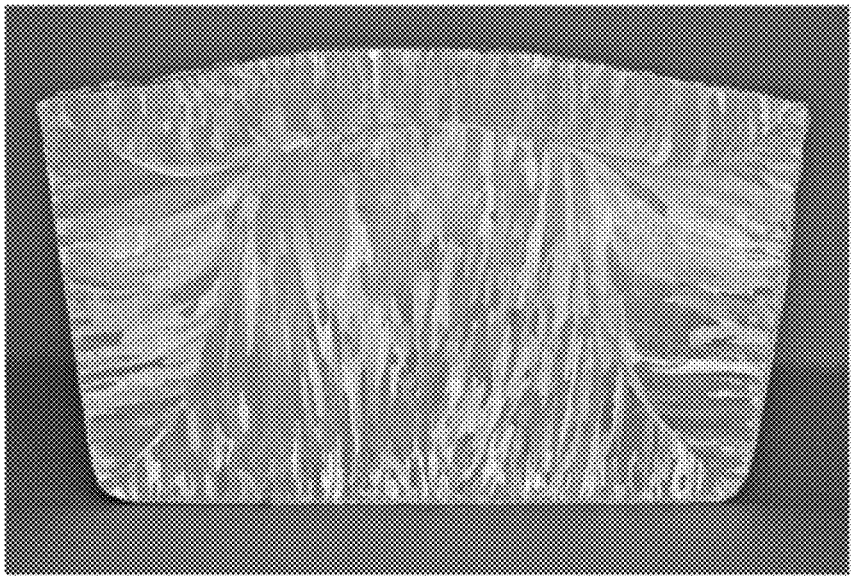
FIG. 4A is a micrograph showing macrostructures present in an aluminum ingot.
Figure 4B:
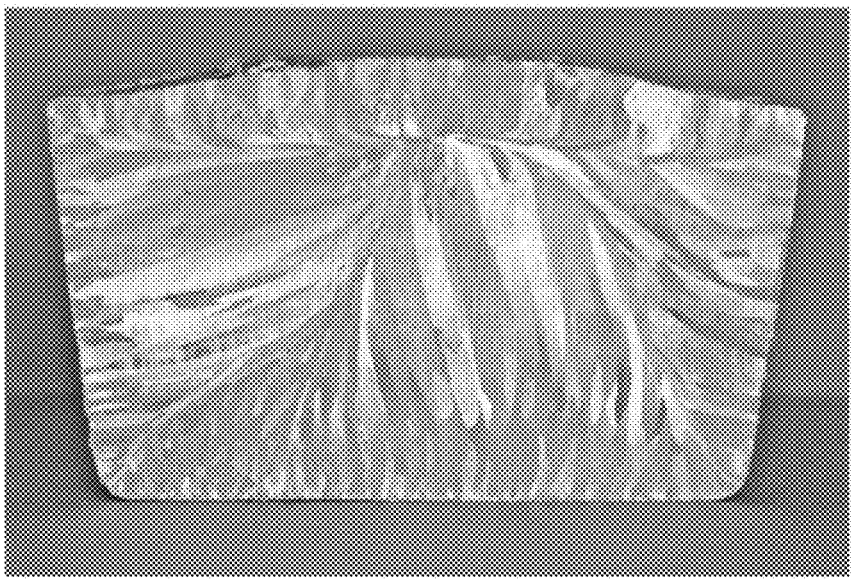
FIG. 4B is another micrograph showing macrostructures present in an aluminum ingot.
Figure 4C:
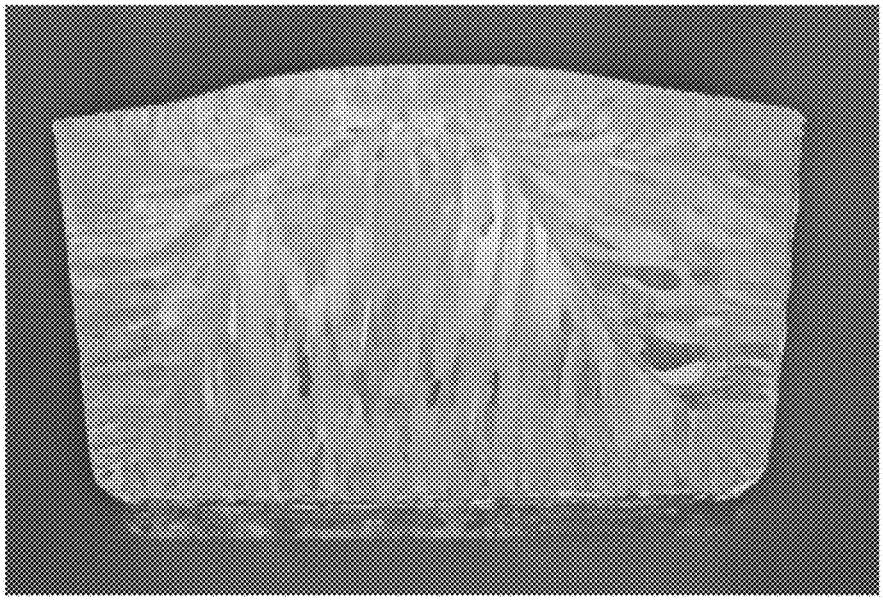
FIG. 4C is another micrograph showing macrostructures present in an aluminum ingot.
Figure 4D:
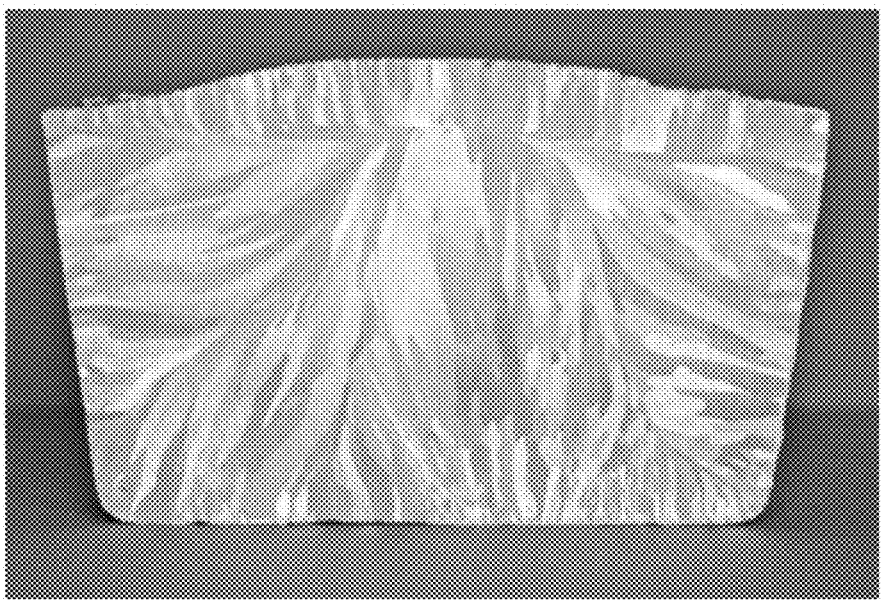
FIG. 4D is another micrograph showing macrostructures present in an aluminum ingot.

FIGS. 4A and 4B are depictions of the macrostructures of a pure aluminum ingot poured without grain refiners and without the ultrasonic vibrations of the present invention. The samples casted were formed at pouring temperatures of 1238° F. or 670° C. (FIG. 4A) and 1292° F. or 700° C. (FIG. 4B), respectively. The mold was cooled by spraying water thereon during the solidification process. A steel channel having a thickness of 6.35 mm was used for the channel structure in FIGS. 4A-4D. FIGS. 4C and 4D are depictions of the macrostructures of a pure aluminum ingot poured without grain refiners and without the ultrasonic vibrations of the present invention. The samples casted were formed at pouring temperatures of 1346° F. or 730° C. (FIG. 4C) and 1400° F. or 760° C. (FIG. 4D), respectively. The mold was once again cooled by spraying water thereon during the solidification process. In FIGS. 4A-4D, the pouring rate was approximately 40 kg/min.

Figure 5:
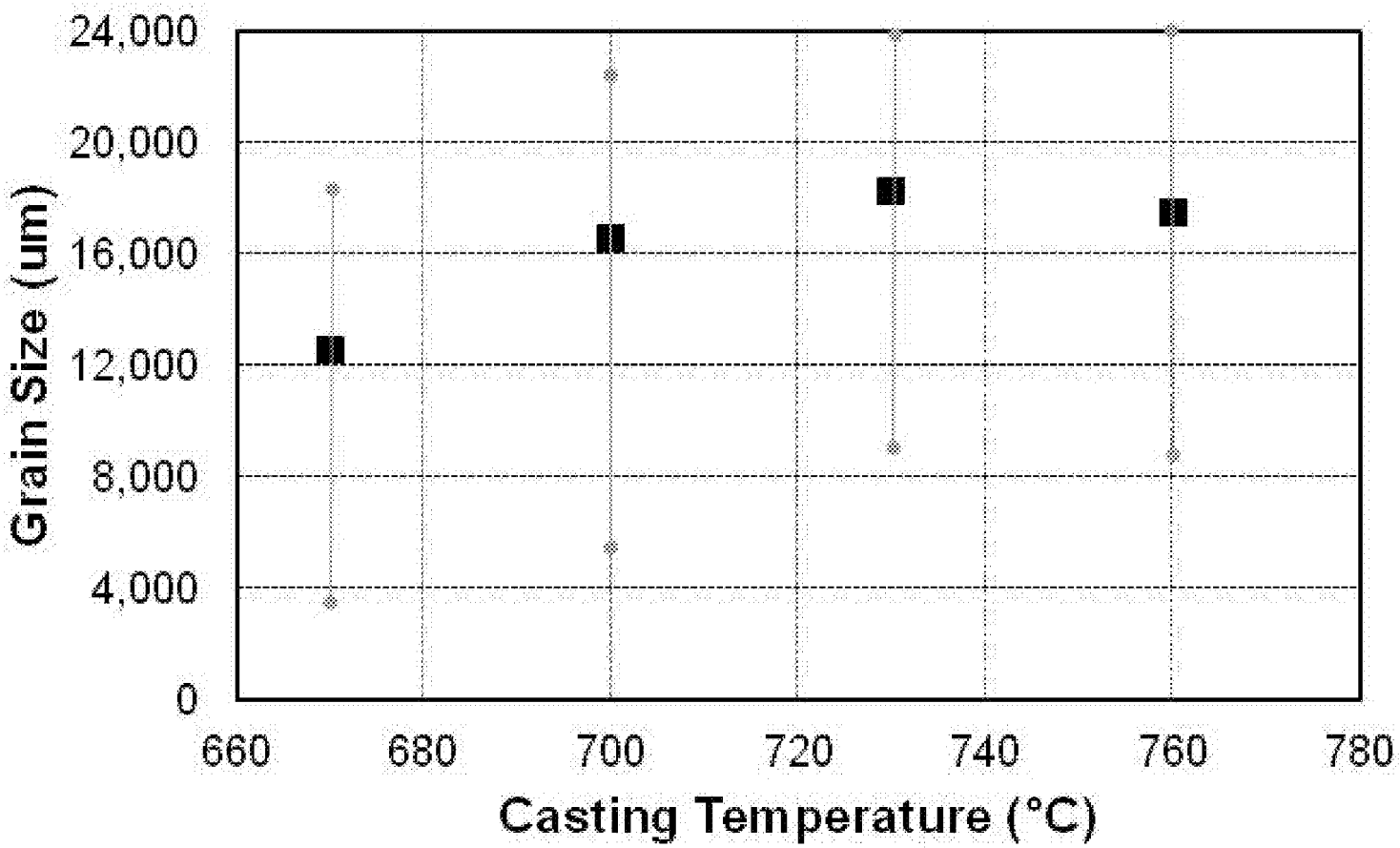
FIG. 5 is a graph depicting grain size as a function of casting temperature.

FIG. 5 is a plot of the measured grain sizes as a function of the pouring (or casting temperature). The grains show crystals which are columnar and have grain sizes ranging from mm to tens of mm with a median grain size from over 12 mm to over 18 mm depending on the casting temperature.

2) Without Grain Refiners and With Ultrasonic Vibration

Figure 6A:
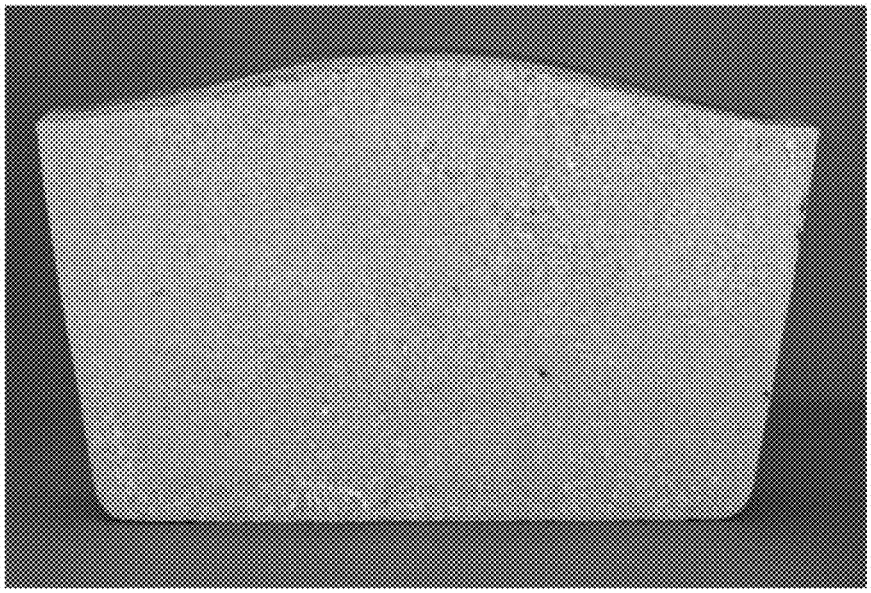
FIG. 6A is a micrograph depicting the macrostructure present in an aluminum ingot; prepared under conditions described herein.
Figure 6B:
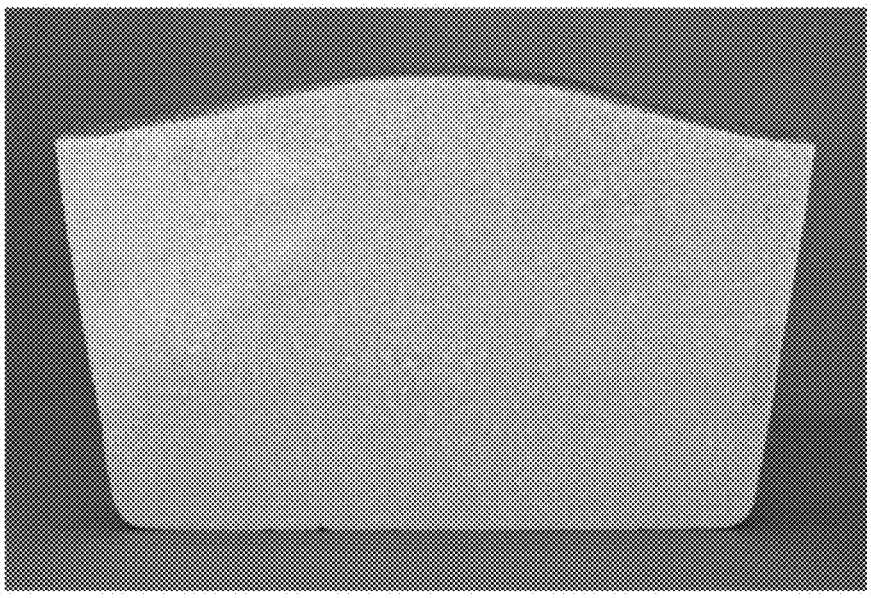
FIG. 6B is another micrograph depicting the macrostructure present in an aluminum ingot; prepared under conditions described herein.
Figure 6C:
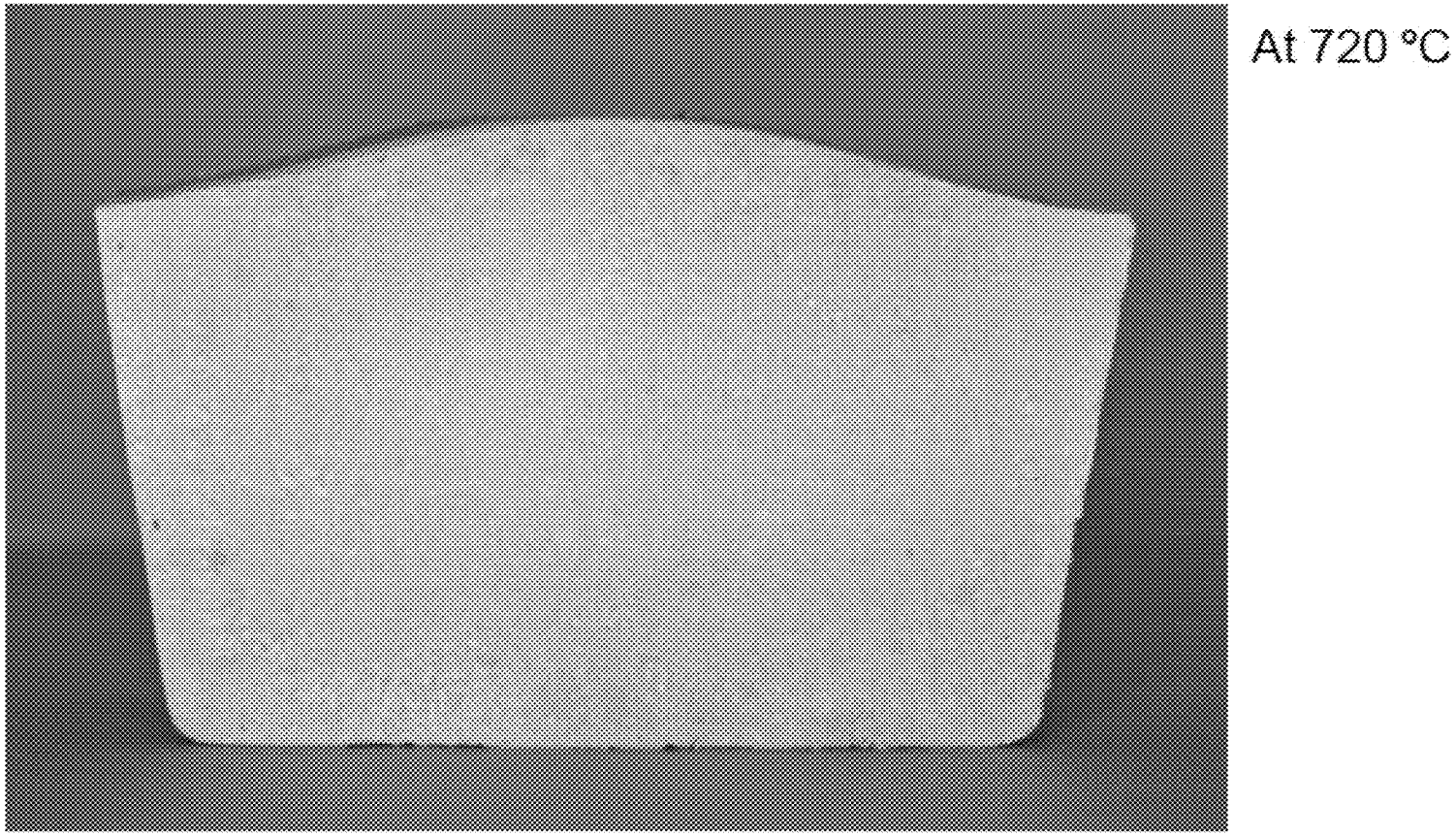
FIG. 6C is another micrograph depicting the macrostructure present in an aluminum ingot; prepared under conditions described herein.

FIGS. 6A-6C are depictions of the macrostructures of a pure aluminum ingot poured without grain refiners and with the ultrasonic vibrations of the present invention. The samples casted were formed at pouring temperatures of 1256° F. or 680° C. (FIG. 6A), 1292° F. or 700° C. (FIG. 6B), and 1328° F. or 720° C. (FIG. 6C), respectively. The mold was cooled by spraying water thereon during the solidification process. A steel channel having a thickness of 6.35 mm was used for the channel structure used to form the samples shown in FIGS. 6A-6C. In these examples, the molten aluminium flowed over the steel channel (a 5 cm wide bottom plate) for a flowing distance of about 35 cm on the upper surface. An ultrasonic vibration probe was installed underneath the upper side of the steel channel structure and located about 7.5 cm from the end of the channel structure where the molten aluminium poured from. In FIGS. 6A-6C, the pouring rate was approximately 40 kg/min. The ultrasonic probe/sonotrode was made of Ti alloy (Ti-6Al-4V). The frequency was 20 kHz, and the intensity of ultrasonic vibration is 50% of the maximum amplitude, about 40 μm.

Figure 7:
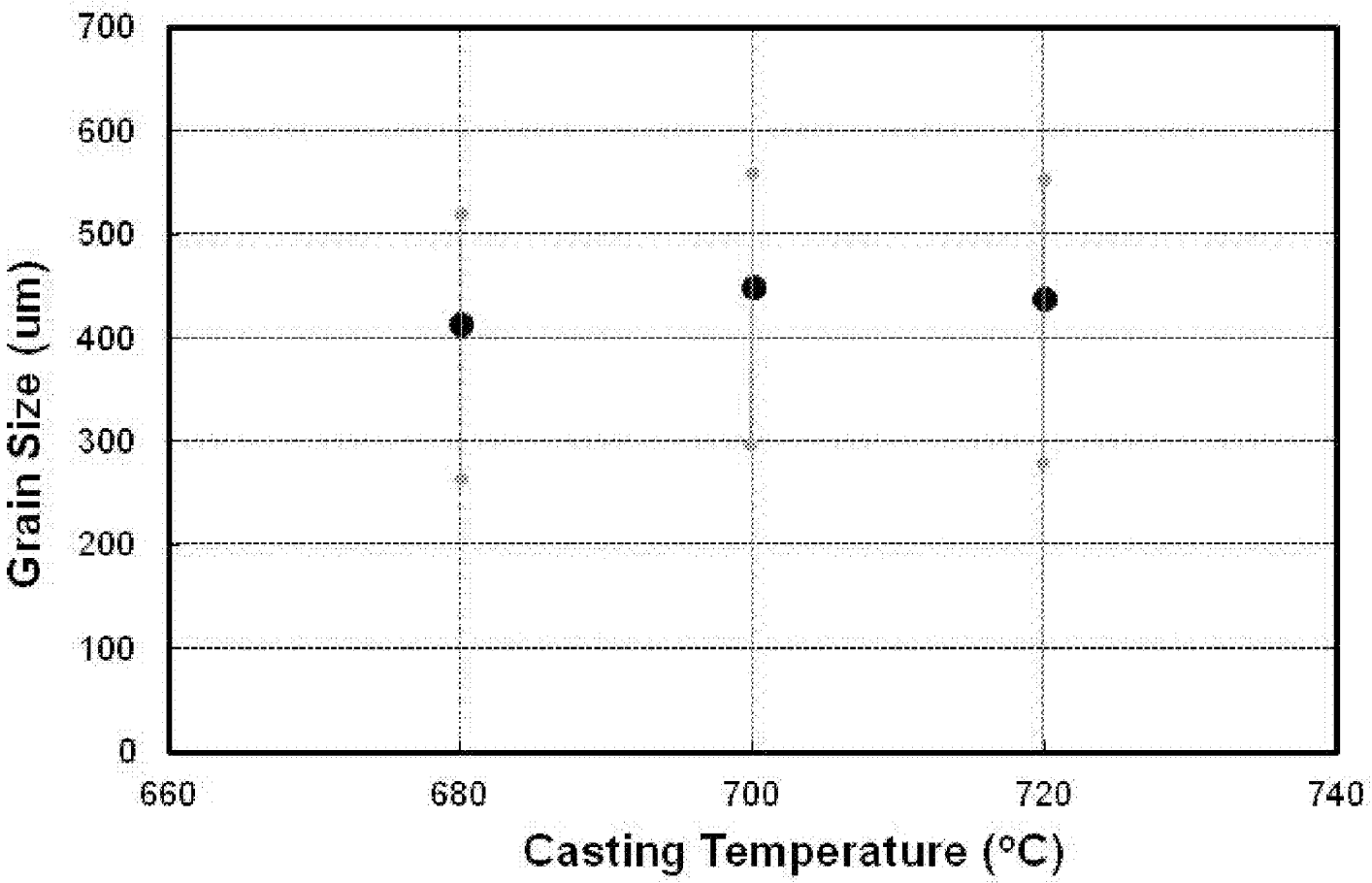
FIG. 7 is another graph depicting grain size as a function of casting temperature.

FIG. 7 is a plot of the measured grain sizes as a function of the pouring (or casting temperature). The grains show crystals which are columnar and have grain sizes of less than 0.5 microns. These results show that the ultrasonic treatment of the present invention is as effective as TIBOR (a titanium and boron containing compound) grain refiners in producing equiaxed grains of pure metal. See, e.g. FIG. 13 for data with samples having TIBOR grain refiners.

Figure 8:
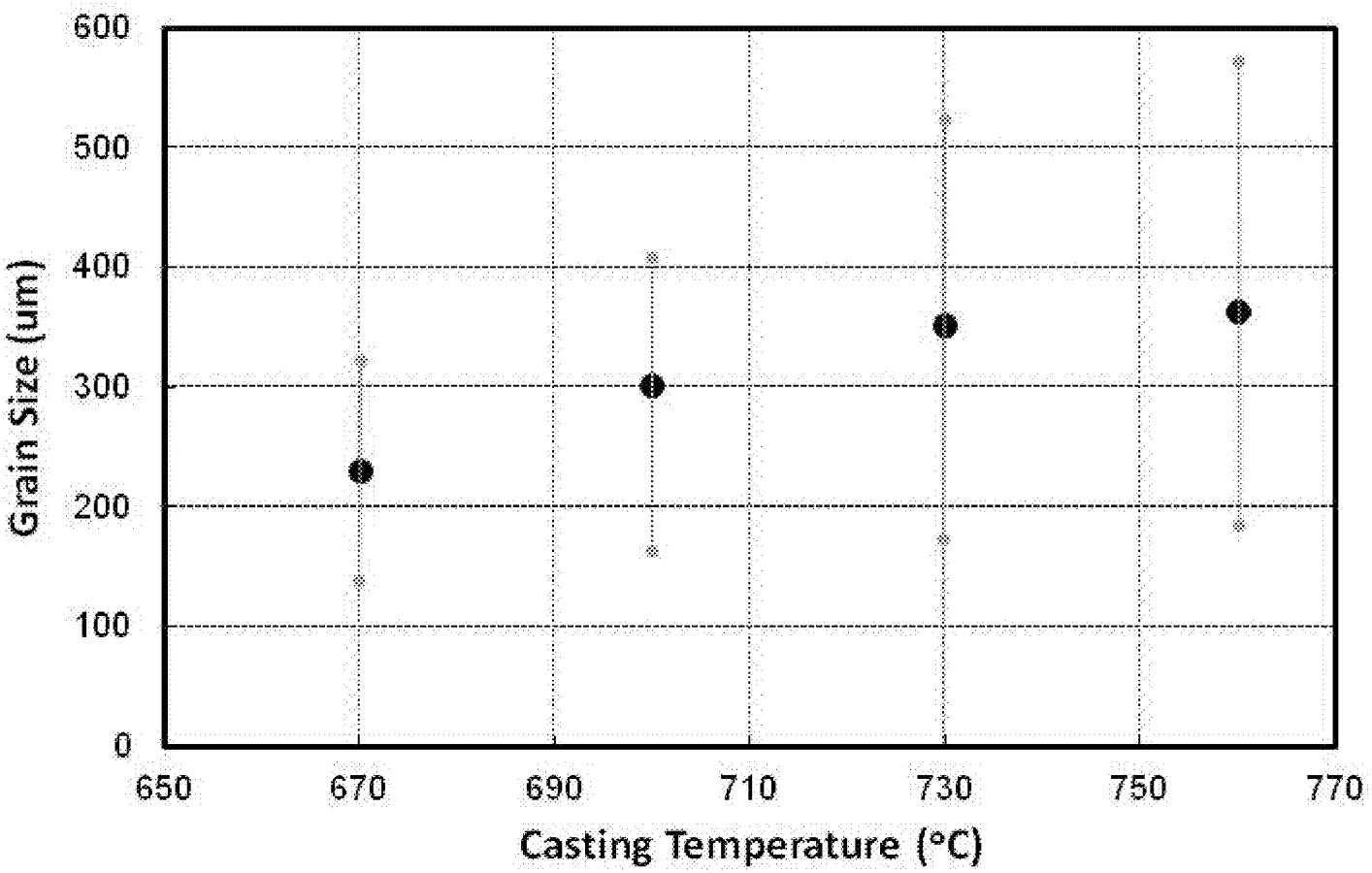
FIG. 8 is another graph depicting grain size as a function of casting temperature.

Further, the effect of the present invention has been realized for even higher pour rates. Using a pour rate of 75 kg/min across a steel channel (a 7.5 cm wide bottom plate) for a flowing distance of about 52 cm on the upper surface the ultrasonic treatment of the present invention was also as effective as TIBOR grain refiners in producing equiaxed grains of pure metal. FIG. 8 is a plot of the measured grain sizes as a function of the pouring (or casting temperature) under the 75 kg/min pour rates.

Figure 9:
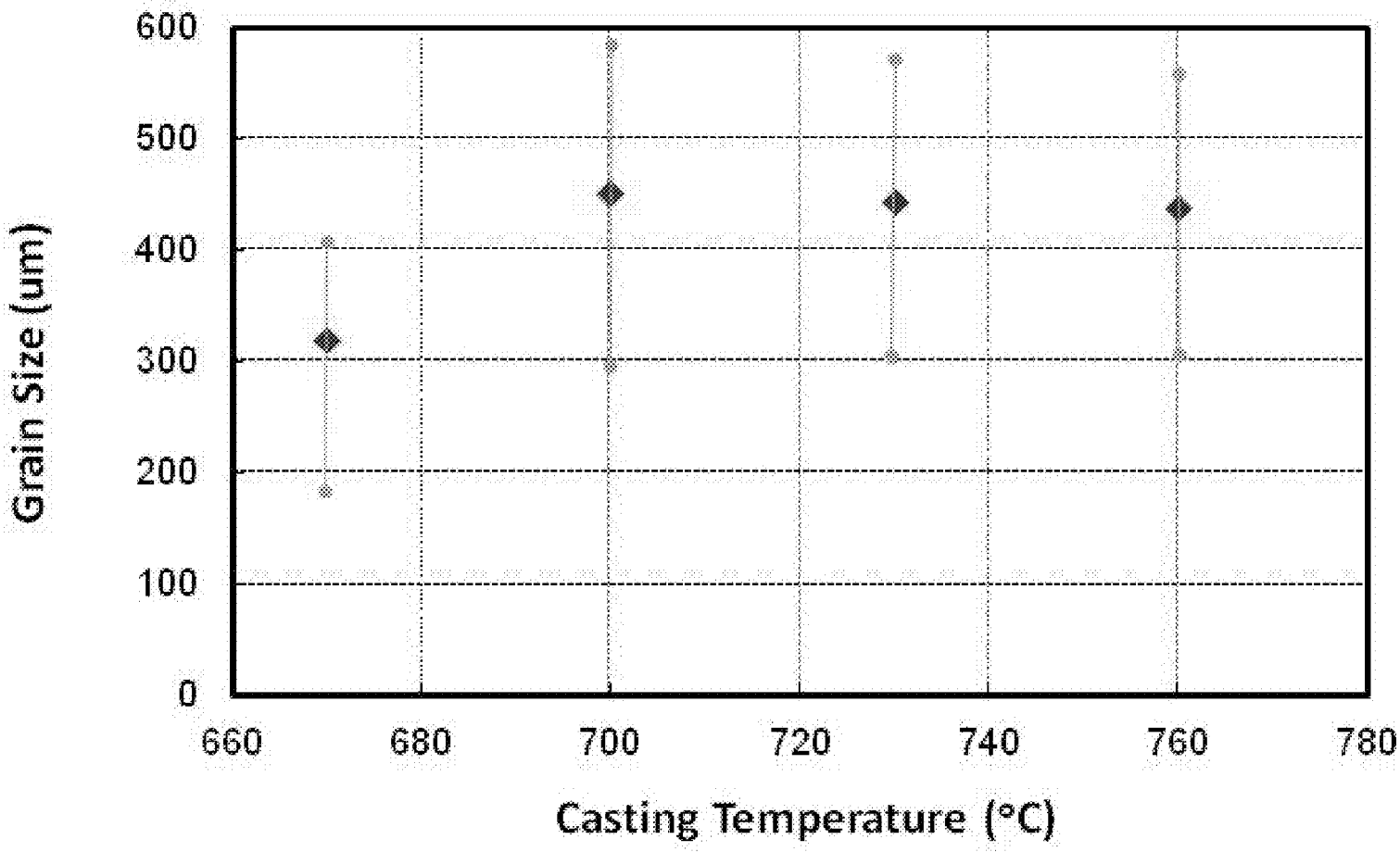
FIG. 9 is another graph depicting grain size as a function of casting temperature.

Similar demonstrations have been made using a copper bottom plate having a thickness of 6.35 mm and the same lateral dimensions as noted above. FIG. 9 is a plot of the measured grain sizes as a function of the pouring (or casting temperature) under the 75 kg/min pour rates and using the copper channel discussed above. The results show that the grain refining effect is better for copper when the casting temperature at 1238° F. or 670° C.

Figure 10:
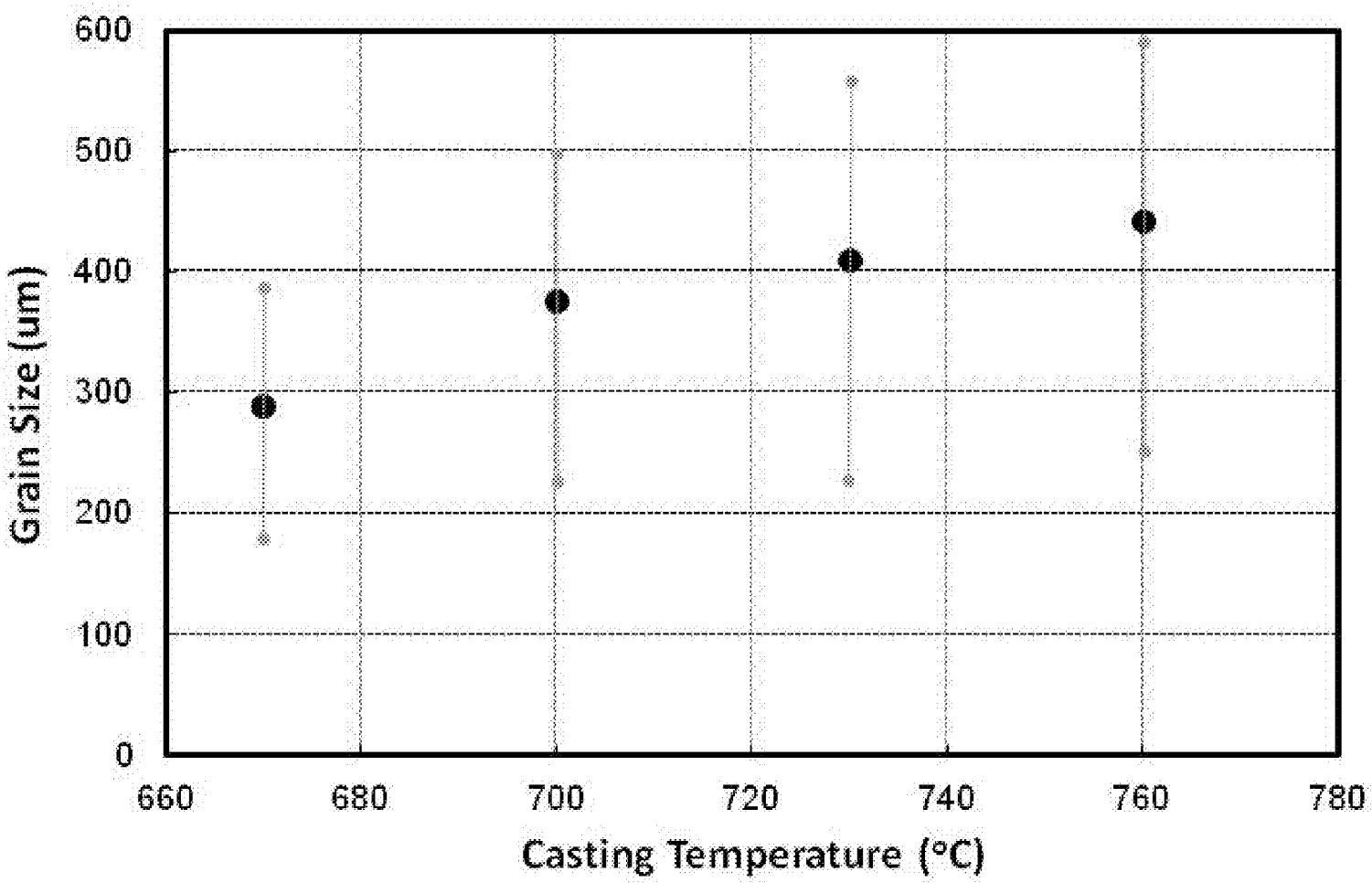
FIG. 10 is another graph depicting grain size as a function of casting temperature.

Similar demonstrations have been made using a niobium bottom plate having a thickness of 1.4 mm and the same lateral dimensions as noted above. FIG. 10 is a plot of the measured grain sizes as a function of the pouring (or casting temperature) under the 75 kg/min pour rates and using the niobium channel discussed above. The results show that the grain refining effect is better for niobium when the casting temperature at 1238° F. or 670° C.

Figure 11A:
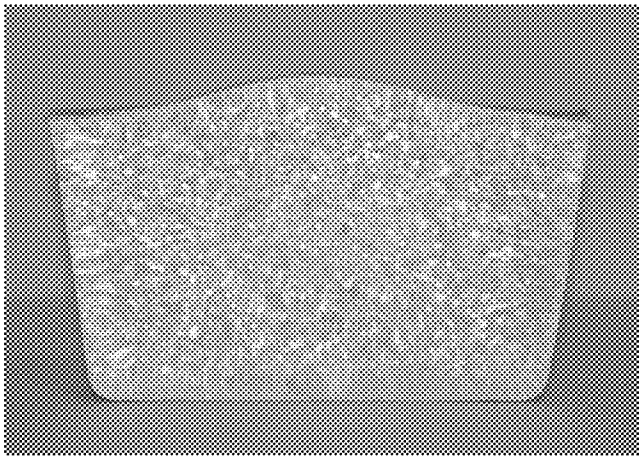
FIG. 11A is a micrograph showing macrostructures present in an aluminum ingot; prepared under conditions described herein.
Figure 11B:
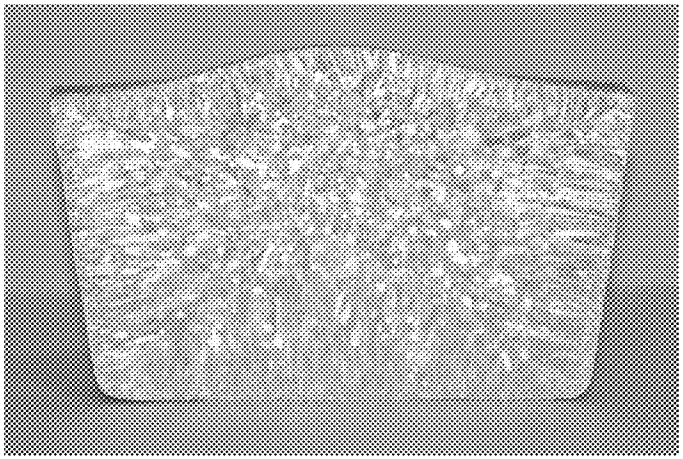
FIG. 11B is another micrograph showing macrostructures present in an aluminum ingot; prepared under conditions described herein.
Figure 11C:
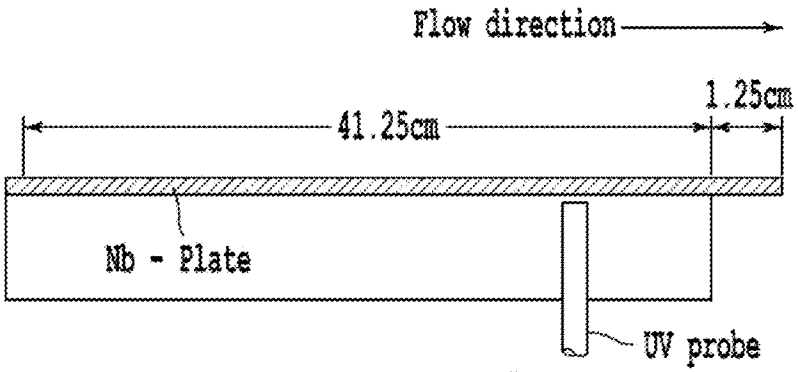
FIG. 11C is a schematic depiction of illustrative dimensions for one embodiment of the casting channels.
Figure 11D:
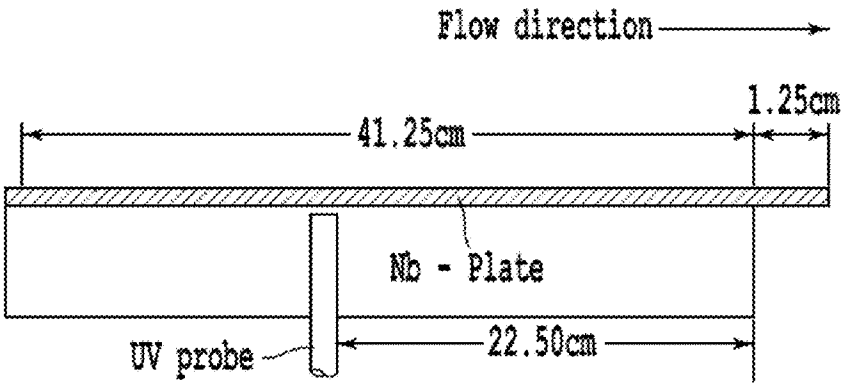
FIG. 11D is a schematic depiction of illustrative dimensions for one embodiment of the casting channels.

In another demonstration of this invention, varying the displacement of the ultrasonic probe from the pouring end of the channel 3 was found to provide a way to vary the grain size without addition of the grain refiners. FIGS. 11A and 11B for the niobium plate described above at respective pouring temperatures of 1346° F. or 730° C. (FIG. 11A) and 1400° F. or 760° C. (FIG. 11B) shows a much coarser grain structure when the distance of the ultrasonic probe from the pouring end was extended from 7.5 cm to a total displacement of 22 cm. FIGS. 11C and 11D are schematics of the experimental positioning and displacement of the ultrasonic probe from which the data regarding the effect of ultrasonic probe displacement were gathered. Displacements below 23 cm or even longer are effective in reducing grain size. However, the window (i.e., the range) for the pouring temperature decreases with increasing distance of between the location of the probe/sonotrode to the metal mold. The present invention is not limited to this range.

Figure 12:
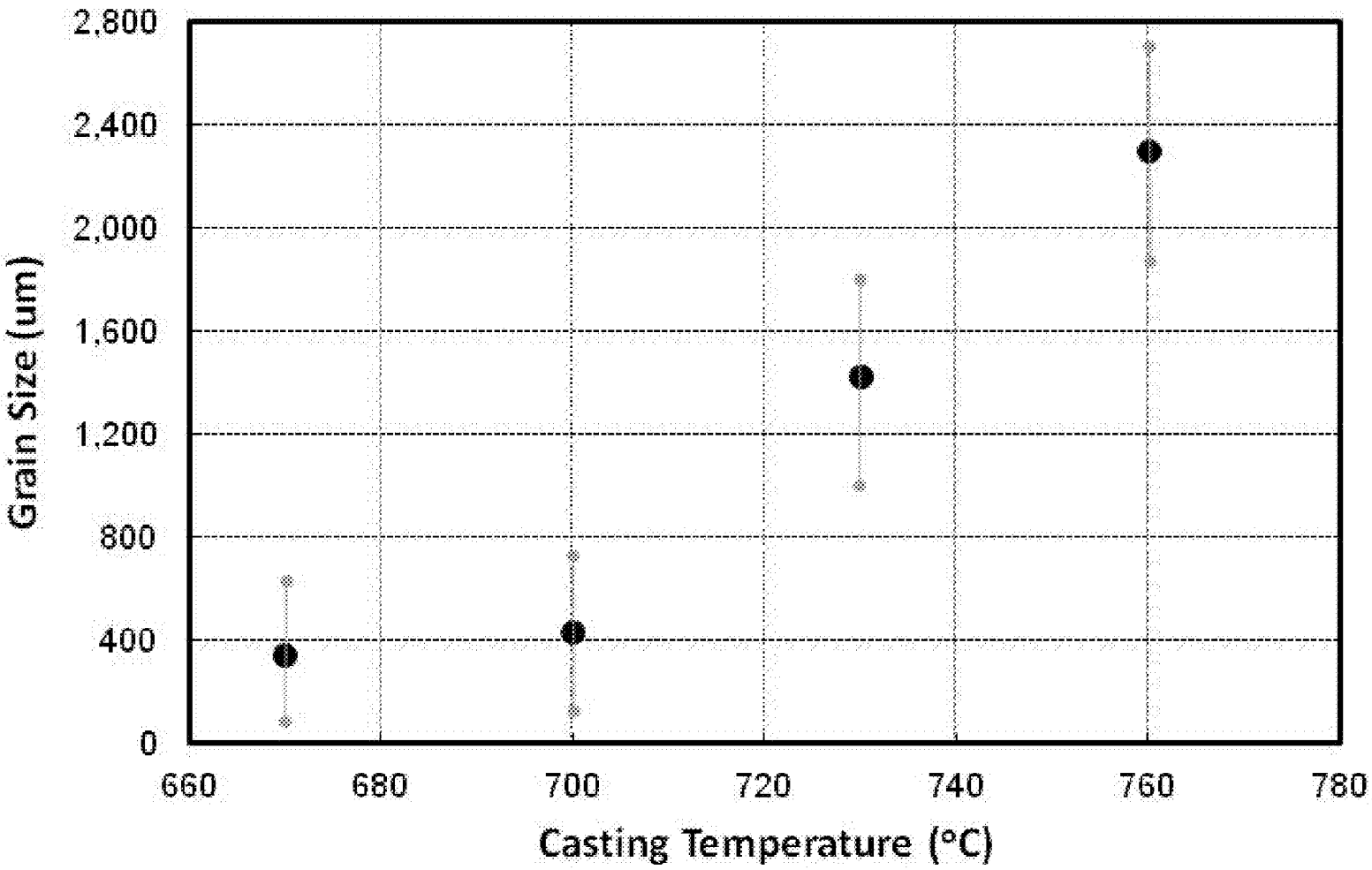
FIG. 12 is another graph depicting grain size as a function of casting temperatures.

FIG. 12 is a plot of the measured grain sizes as a function of the pouring (or casting temperature) under the 75 kg/min pour rates and using the niobium channel discussed above but with the distance of the ultrasonic probe from the pouring end extended for the total displacement of 22 cm. This plot shows that the grain sizes are significantly affected by the pouring temperature. The grain sizes are much larger and with partial columnar crystals when the pouring temperature is higher than about 1300° F. or 704° C., while the grain sizes are nearly equivalent to other conditions by the pouring temperature less than 1292° F. or 700° C.

Moreover, at higher temperatures, the use of grain refiners typically resulted in a smaller grain size than at lower temperatures. The average grain size of the grain refined ingot at 760° C. was 397.76 μm, while the average grain size of the ultrasonic vibrations treated ingot was 475.82 μm, with the standard deviation of the grain sizes being around 169 μm and 95 μm, respectively, showing that the ultrasonic vibrations produced more uniform grains than did the Al—Ti—B grain refiner.

In one particularly attractive aspect of the present invention, at lower temperatures, the ultrasonic vibration treatment is more effective than the adding of grain refiners.

In another aspect of the present invention, the pouring temperature can be used to control changing the grain size in ingots subjected to ultrasonic vibration. The inventors observed that the grain size decreased with a decreasing pouring temperature. The inventors also observed that equiaxed grains occurred when using ultrasonic vibration and when the melt is poured into a mold at temperatures within 10° C. above the liquidus temperature of the alloy being poured.

Figure 13A:
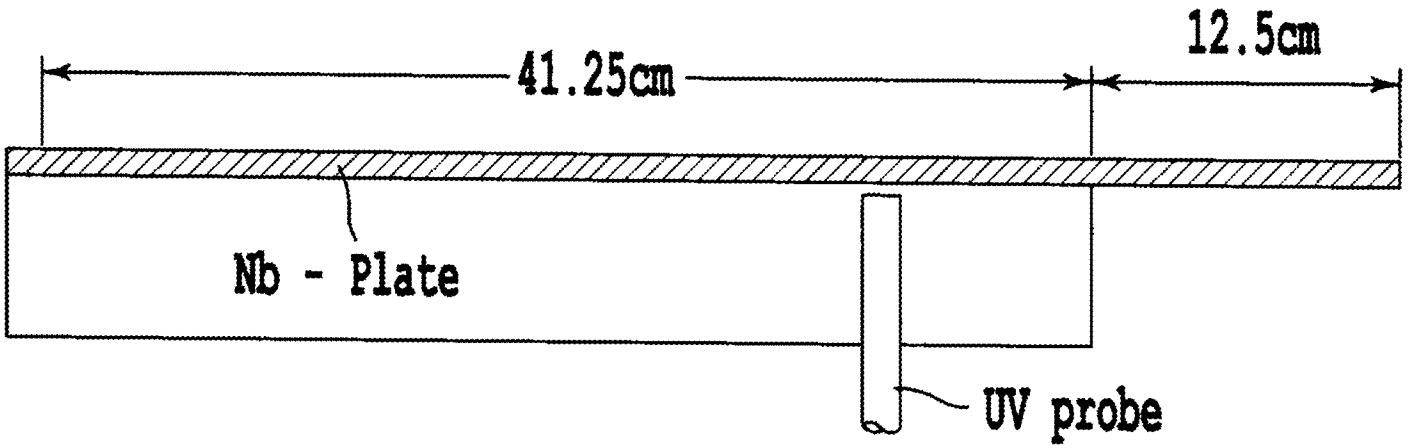
FIG. 13A is another schematic depiction of illustrative dimensions for one embodiment of a casting channel.
Figure 13B:
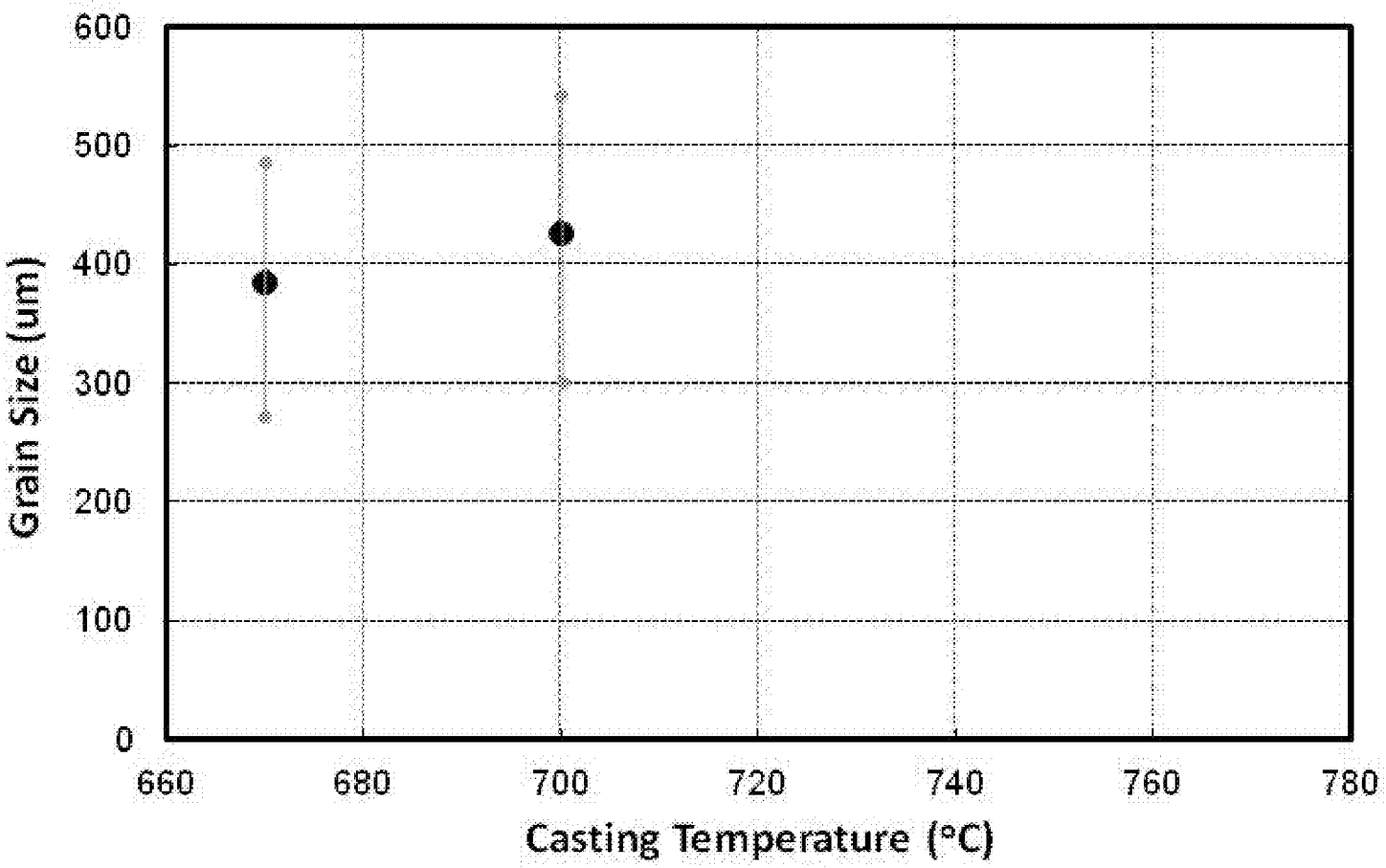
FIG. 13B is another graph depicting grain size as a function of casting temperatures.

FIG. 13A is schematic of an extended running end configuration. In the extended running end configuration of FIG. 13A, the niobium channel's running end is extended to about 12.5 cm from 1.25 cm, and the ultrasonic probe position is located from 7.5 cm to the tube end. The extended running end is realized by adding a niobium plate to the original running end. FIG. 13B is a graph depicting the effect of casting temperature on the resultant grain size, when using a niobium channel. The grain sizes realized were effectively equivalent to the shorter running end when the pouring temperature less than 1292° F. or 700° C.

The present invention is not limited to the application of use of ultrasonic vibrations merely to the channel structure described above. In general, the ultrasonic vibrations can induce nucleation at points in the casting process where the molten metal is beginning to cool from the molten state and enter the solid state (i.e., the thermal arrest state). Viewed differently, the invention, in various embodiments, combines ultrasonic vibration with thermal management such that the molten metal adjacent to the cooling surface is close to the liquidus temperature of the alloy. In these embodiments, the surface temperature of the cooling plate is low enough to induce nucleation and crystal growth (dendrite formation) while ultrasonic vibration creates nuclei and breaks up dendrites that may form on the surface of the cooling plate.

Alternative Configurations

Accordingly, in the invention, ultrasonic vibrations (besides those introduced in the channel structure noted above) can be used to induce nucleation at an entrance point of the molten metal into the mold by way of an ultrasonic vibrator preferably coupled to the mold entrance by way of a liquid coolant. This option may be more attractive in a stationary mold. In some casting configurations (for example with a vertical casting), this option may be the only practical implementation.

Alternatively or in conjunction, ultrasonic vibrations can induce nucleation at a launder which provides the molten metal to the channel structure or which provides the molten metal directly to a mold. As before, the ultrasonic vibrator is preferably coupled to the launder and thus to the molten metal by way of a liquid coolant.

Figure 14:
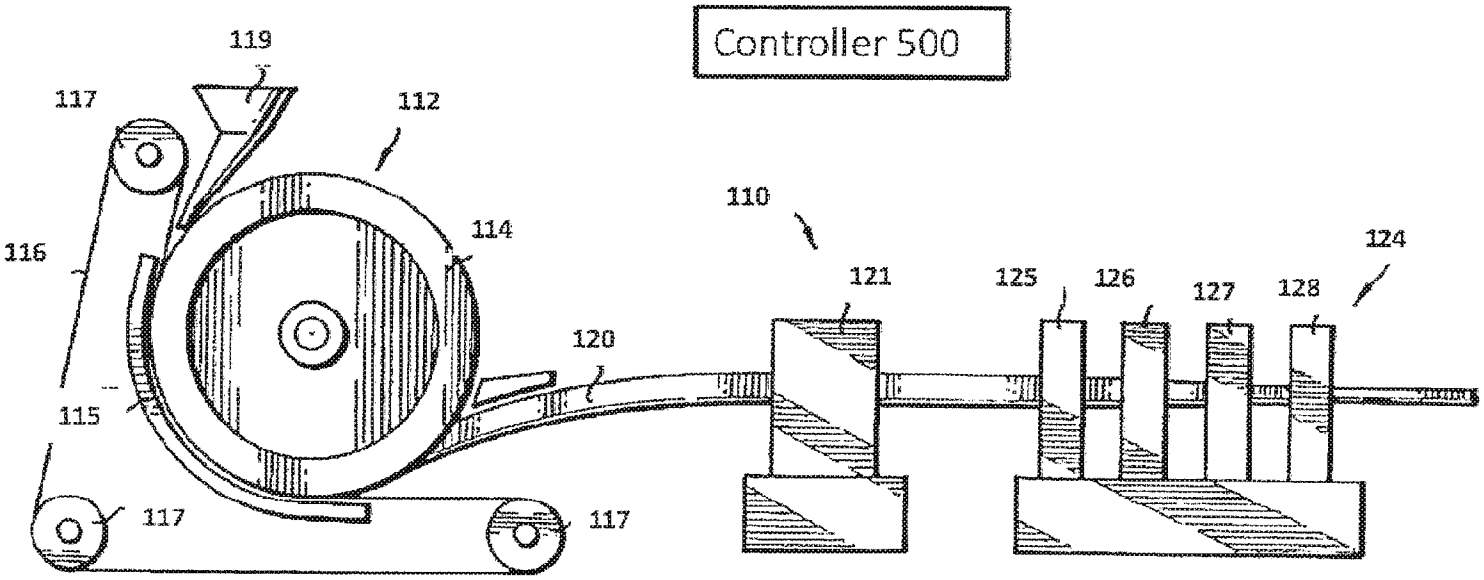
FIG. 14 is a schematic of a continuous casting machine according to one embodiment of the invention.

Moreover, besides use of the present invention's ultrasonic vibrations treatment in casting into stationary molds and into the continuous rod-type molds described above, the present invention also has utility in the casting mill described in U.S. Pat. No. 4,733,717 (the entire contents of which are incorporated herein by reference). As shown in FIG. 14 (reproduced from that patent), a continuous casting and hot-forming system 110 includes a casting machine 112 which further includes a casting wheel 114 having a peripheral groove therein, a flexible band 116 carried by a plurality of guide wheels 117 which bias the flexible band 116 against the casting wheel 114 for a portion of the circumference of the casting wheel 114 to cover the peripheral groove and form a mold between the band 116 and the casting wheel 114. As molten metal is poured into the mold through the pouring spout 119, the casting wheel 114 is rotated and the band 116 moves with the casting wheel 114 to form a moving mold. The pouring spout 119 would include as a separate attachment (or would have integrated therewith the components of) the channel structure 2 shown in FIGS. 1A-1B (or other channel structures described elsewhere in this specification) in order to provide the ultrasonic treatment to the molten metal to induce nucleation sites.

A cooling system 115 of casting machine 112 causes the molten metal to uniformly solidify in the mold and to exit the casting wheel 114 as a cast bar 120.

From the casting machine 112, the cast bar 120 passes through a heating means 121. Heating means 121 functions as a pre-heater for raising the bar 120 temperature from about 1700° f or 927° C. to about 1750° F. or 954° C. Immediately after pre-heating, the bar 120 is passed through a conventional rolling mill 124, which includes roll stands 125, 126, 127 and 128. The roll stands of the rolling mill 124 provide the primary hot forming of the cast bar by compressing the pre-heated bar sequentially until the bar is reduced to a desired cross-sectional size and shape.

FIG. 14 also shows controller 500 which controls the various parts of the continuously casting system shown therein. As discussed in detail below, controller 500 includes one or more processors with programmed instructions to control the operation of the continuous copper casting system depicted in FIG. 14.

Moreover, besides use of the present invention's ultrasonic vibrations treatment in casting into stationary molds and into the continuous wheel-type casting systems described above, the present invention also has utility in vertical casting mills.

Figures 15A, 15B, 15C, 15D:
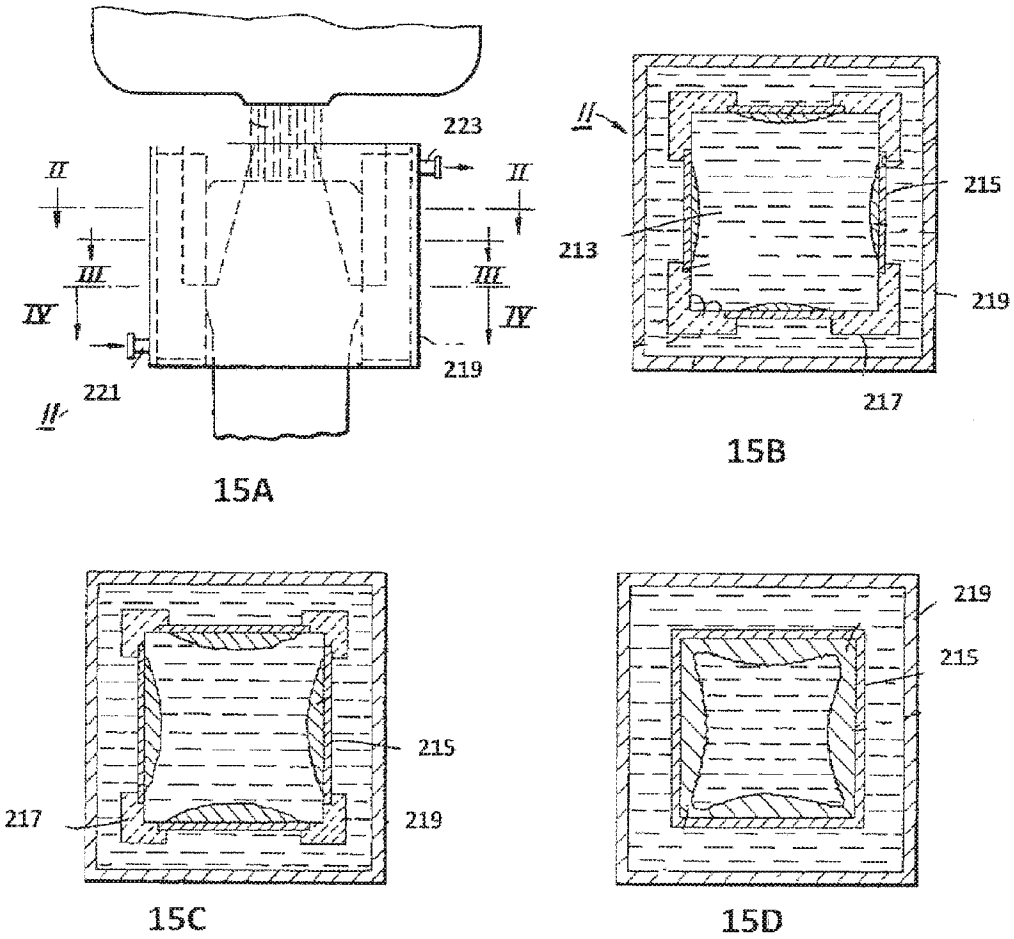
FIG. 15A is a cross sectional schematic of one component of a vertical casting mill.
FIG. 15B is a cross sectional schematic of another component of a vertical casting mill.
FIG. 15C is a cross sectional schematic of another component of a vertical casting mill.
FIG. 15D is a cross sectional schematic of another component of a vertical casting mill.

FIG. 15 depicts selected components of a vertical casting mill. More details of these components and other aspects of a vertical casting mill are found in U.S. Pat. No. 3,520,352 (the entire contents of which are incorporated herein by reference). As shown in FIG. 15, the vertical casting mill includes a molten metal casting cavity 213, which is generally square in the embodiment illustrated, but which may be round, elliptical, polygonal or any other suitable shape, and which is bounded by vertical, mutually intersecting first wall portions 215, and second or corner wall portions, 217, situated in the top portion of the mold. A fluid retentive envelope 219 surrounds the walls 215 and corner members 217 of the casting cavity in spaced apart relation thereto. Envelope 219 is adapted to receive a cooling fluid, such as water, via an inlet conduit 221, and to discharge the cooling fluid via an outlet conduit 223.

While the first wall portions 215 are preferably made of a highly thermal conductive material such as copper, the second or corner wall portions 217 are constructed of lesser thermally conductive material, such as, for example, a ceramic material. As shown in FIG. 15, the corner wall portions 217 have a generally L-shaped or angular cross section, and the vertical edges of each corner slope downwardly and convergently toward each other. Thus, the corner member 217 terminates at some convenient level in the mold above of the discharge end of the mold which is between the transverse sections.

In operation, molten metal flows from a tundish into a casting mold that reciprocates vertically and a cast strand of metal is continuously withdrawn from the mold. The molten metal is first chilled in the mold upon contacting the cooler mold walls in what may be considered as a first cooling zone. Heat is rapidly removed from the molten metal in this zone, and a skin of material is believed to form completely around a central pool of molten metal.

In the present invention, the channel structure 2 (or similar structure to that shown in FIG. 1) could be provided as a part of a pouring device to transport the molten metal to the molten metal casting cavity 213. In this configuration, the channel structure 2 with its ultrasonic probe would provide the ultrasonic treatment to the molten metal to induce nucleation sites.

In an alternative configuration, an ultrasonic probe would be disposed in relation to the fluid retentive envelope 219 and preferably into the cooling medium circulating in the fluid retentive envelope 219. As before, ultrasonic vibrations can induce nucleation in the molten metal, e.g., in its thermal arrest state in which the molten metal is converting from a liquid to a solid, as the cast strand of metal is continuously withdrawn from the metal casting cavity 213.

Thermal Management

As noted above, in one aspect of the present invention, ultrasonic vibrations from an ultrasonic probe are coupled with a liquid medium to better refine the grains in metals and metallic alloys, and to create a more uniform solidification. The ultrasonic vibrations preferably are communicated to the liquid metal via an intervening liquid cooling medium.

While not limited to any particular theory of operation, the following discussion illustrates some of the factors influencing the ultrasonic coupling.

It is preferred that the cooling liquid flow be provided at a sufficient rate to undercool the metal adjacent to the cooling plate (less than ~5 to 10° C. above the liquidus temperature of the alloy or slightly below the liquidus temperature). Thus, one attribute of the present invention uses these cooling plate conditions and ultrasonic vibration to reduce the grain size of a large quantity of metal. Prior techniques using ultrasonic vibration for grain refining worked only for a small quantity of metal at short cast times. The use of a cooling system ensures that this invention can be used for a large quantity of metal for long times or otherwise continuous casting.

In one embodiment, the flow rate of the cooling medium is preferably, but not necessarily, sufficient to prevent the heat rate transiting the bottom plate and into the walls of the cooling channel from producing a water vapor pocket which could disrupt the ultrasonic coupling.

In one consideration of the temperature flux from the molten metal into the cooling channel, the bottom plate (through design of its thickness and the material of construction) may be designed to support a majority of the temperature drop from the molten metal temperature to the cooling water temperature. If for example, the temperature drop across the thickness of the bottom plate is only a few 100° C., then the remaining temperature drops will exist across a water/water-vapor interface, potentially degrading the ultrasonic coupling.

Furthermore, as noted above, the bottom plate 2*b* of the channel structure can be attached to the wall of the liquid medium passage 2*c* permitting different materials to be used for these two elements. In this design consideration, materials of different thermal conductivity can be used to distribute the temperature drop in a suitable manner. Furthermore, the cross sectional shape of the liquid medium passage 2*c* and/or the surface finish of the interior wall of the liquid medium passage 2*c* can be adjusted to further the exchange of heat into the cooling medium without the development of a vapor-phase interface. For example, intentional surface protrusions can be provide on the interior wall of the liquid medium passage 2*c* to promote nucleate boiling characterized by the growth of bubbles on a heated surface, which arise from discrete points on a surface, whose temperature is only slightly above the liquid temperature.

Metal Products

In one aspect of the present invention, products including a cast metallic composition can be made without the necessity of grain refiners and still having sub-millimeter grain sizes. Accordingly, the cast metallic compositions can be made with less than 5% of the compositions including the grain refiners and still obtain sub-millimeter grain sizes. The cast metallic compositions can be made with less than 2% of the compositions including the grain refiners and still obtain sub-millimeter grain sizes. The cast metallic compositions can be made with less than 1% of the compositions including the grain refiners and still obtain sub-millimeter grain sizes. In a preferred composition, the grain refiners are less than 0.5% or less than 0.2% or less than 0.1%. The cast metallic compositions can be made with the compositions including no grain refiners and still obtain sub-millimeter grain sizes.

The cast metallic compositions can have a variety of sub-millimeter grain sizes depending on a number of factors including the constituents of the "pure" or alloyed metal, the pour rates, the pour temperatures, the rate of cooling. The list of grain sizes available to the present invention includes the following. For aluminum and aluminum alloys, grain sizes range from 200 to 900 micron, or 300 to 800 micron, or 400 to 700 micron, or 500 to 600 micron. For copper and copper alloys, grain sizes range from 200 to 900 micron, or 300 to 800 micron, or 400 to 700 micron, or 500 to 600 micron. For gold, silver, or tin or alloys thereof, grain sizes range from 200 to 900 micron, or 300 to 800 micron, or 400 to 700 micron, or 500 to 600 micron. For magnesium or magnesium alloys, grain sizes range from 200 to 900 micron, or 300 to 800 micron, or 400 to 700 micron, or 500 to 600 micron. While given in ranges, the invention is capable of intermediate values as well. In one aspect of the present invention, small concentrations (less than 5%) of the grain refiners may be added to further reduce the grain size to values between 100 and 500 micron. The cast metallic compositions can include aluminum, copper, magnesium, zinc, lead, gold, silver, tin, bronze, brass, and alloys thereof.

The cast metallic compositions can be drawn or otherwise formed into bar stock, rod, stock, sheet stock, wires, billets, and pellets.

Computerized Control

Figure 16:
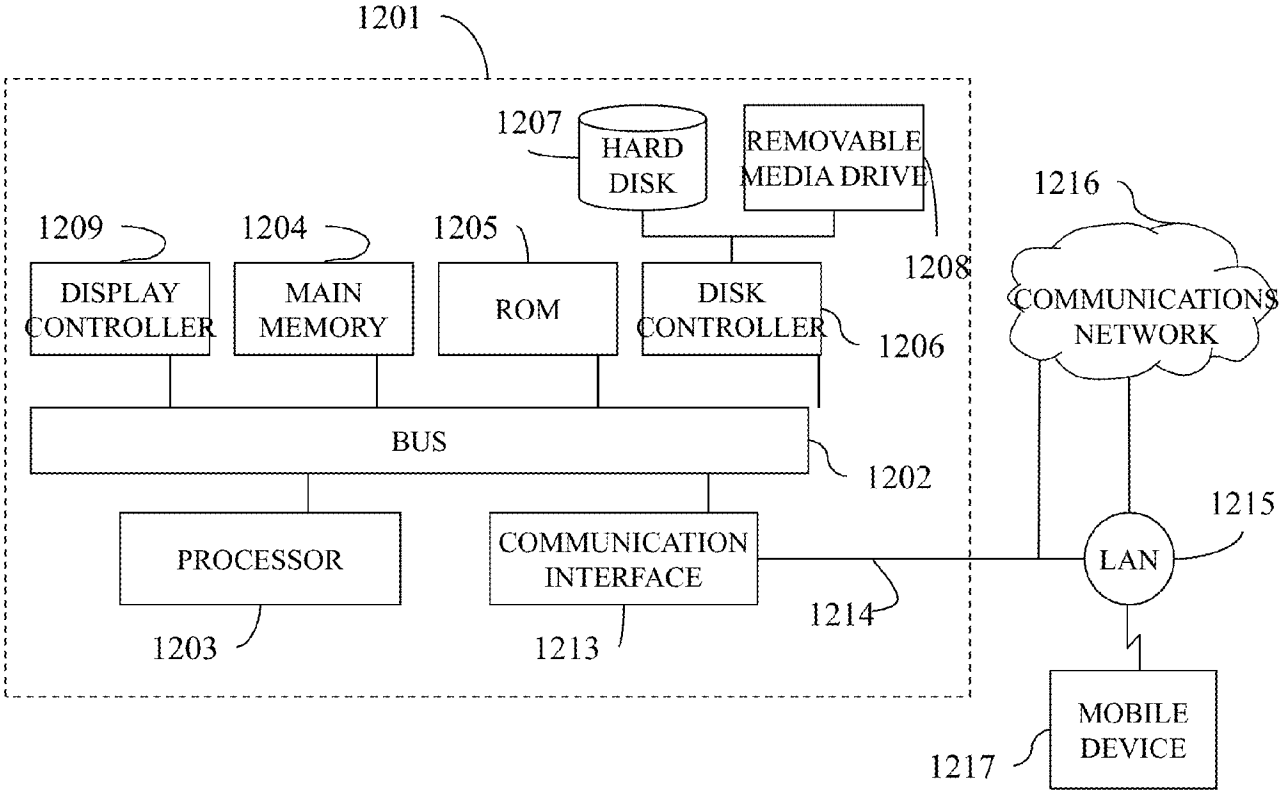
FIG. 16 is a schematic of an illustrative computer system for the controls and controllers depicted herein.

The controller 500 in FIGS. 3A, 3B, and 14 can be implemented by way of the computer system 1201 shown in FIG. 16. The computer system 1201 may be used as the controller 500 to control the casting systems noted above or any other casting system or apparatus employing the ultrasonic treatment of the present invention. While depicted singularly in FIGS. 3A, 3B, and 14 as one controller, controller 500 may include discrete and separate processors in communication with each other and/or dedicated to a specific control function.

Figure 17:
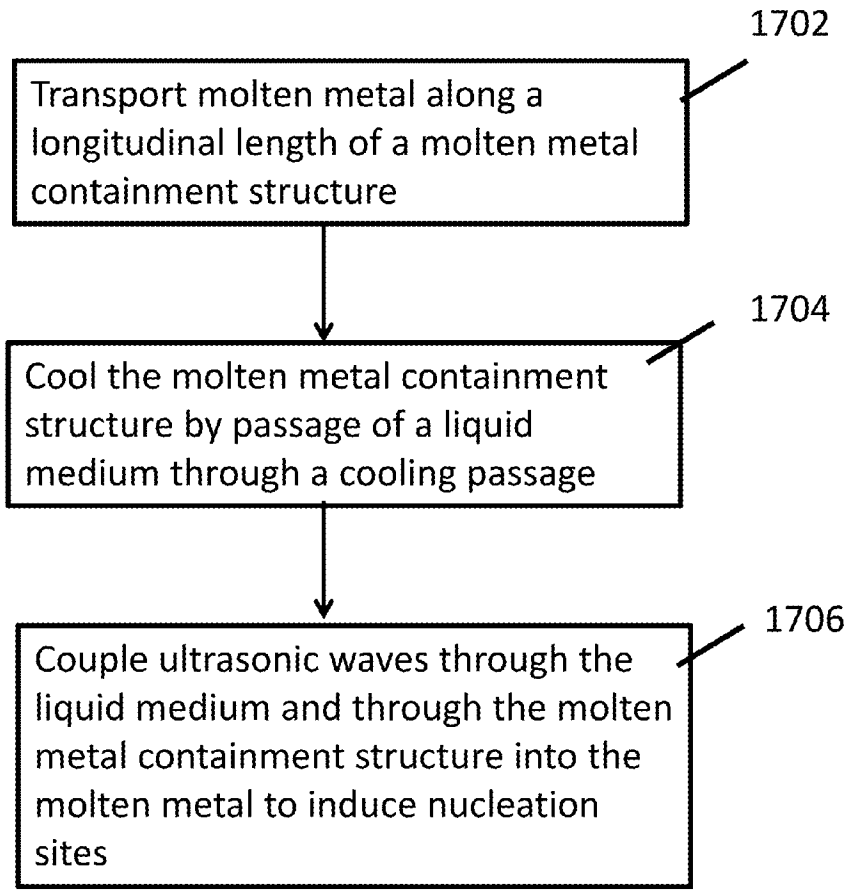
FIG. 17 is a flow chart depicting a method according to one embodiment of the invention.

In particular, the controller 500 can be programmed specifically with control algorithms carrying out the functions depicted by the flowchart in FIG. 17.

FIG. 17 depicts a flowchart whose elements can be programmed or stored in a computer readable medium or in one of the data storage devices discussed below. The flowchart of FIG. 17 depicts a method of the present invention for inducing nucleation sites in a metal product. At step element 1702, the programmed element would direct the operation of transporting molten metal, in a state of thermal arrest in which the metal is converting from a liquid to a solid, along a longitudinal length of a molten metal containment structure. At step element 1704, the programmed element would direct the operation of cooling the molten metal containment structure by passage of a liquid medium through a cooling channel. At step element 1706, the programmed element would direct the operation of coupling ultrasonic waves through the liquid medium in the cooling channel and through the molten metal containment structure into the molten metal. In this element, the ultrasonic waves would have a frequency and power which induces nucleation sites in the molten metal, as discussed above.

Elements such as the molten metal temperature, pouring rate, cooling flow through the cooling channel passages, and mold cooling and elements relate to the control and draw of the cast product through the mill would be programmed with standard software languages (discussed below) to produce special purpose processors containing instructions to apply the method of the present invention for inducing nucleation sites in a metal product.

More specifically, computer system 1201 shown in FIG. 16 includes a bus 1202 or other communication mechanism for communicating information, and a processor 1203 coupled with the bus 1202 for processing the information. The computer system 1201 also includes a main memory 1204, such as a random access memory (RAM) or other dynamic storage device (e.g., dynamic RAM (DRAM), static RAM (SRAM), and synchronous DRAM (SDRAM)), coupled to the bus 1202 for storing information and instructions to be executed by processor 1203. In addition, the main memory 1204 may be used for storing temporary variables or other intermediate information during the execution of instructions by the processor 1203. The computer system 1201 further includes a read only memory (ROM) 1205 or other static storage device (e.g., programmable read only memory (PROM), erasable PROM (EPROM), and electrically erasable PROM (EEPROM)) coupled to the bus 1202 for storing static information and instructions for the processor 1203.

The computer system 1201 also includes a disk controller 1206 coupled to the bus 1202 to control one or more storage devices for storing information and instructions, such as a magnetic hard disk 1207, and a removable media drive 1208 (e.g., floppy disk drive, read-only compact disc drive, read/write compact disc drive, compact disc jukebox, tape drive, and removable magneto-optical drive). The storage devices may be added to the computer system 1201 using an appropriate device interface (e.g., small computer system interface (SCSI), integrated device electronics (IDE), enhanced-IDE (E-IDE), direct memory access (DMA), or ultra-DMA).

The computer system 1201 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)).

The computer system 1201 may also include a display controller 1209 coupled to the bus 1202 to control a display, such as a cathode ray tube (CRT), for displaying information to a computer user. The computer system includes input devices, such as a keyboard and a pointing device, for interacting with a computer user (e.g. a user interfacing with controller 500) and providing information to the processor 1203.

The computer system 1201 performs a portion or all of the processing steps of the invention (such as for example those described in relation to providing vibrational energy to a liquid metal in a state of thermal arrest) in response to the processor 1203 executing one or more sequences of one or more instructions contained in a memory, such as the main memory 1204. Such instructions may be read into the main memory 1204 from another computer readable medium, such as a hard disk 1207 or a removable media drive 1208. One or more processors in a multi-processing arrangement may also be employed to execute the sequences of instructions contained in main memory 1204. In alternative embodiments, hard-wired circuitry may be used in place of or in combination with software instructions. Thus, embodiments are not limited to any specific combination of hardware circuitry and software.

As stated above, the computer system 1201 includes at least one computer readable medium or memory for holding instructions programmed according to the teachings of the invention and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium, or other physical medium, a carrier wave (described below), or any other medium from which a computer can read.

Stored on any one or on a combination of computer readable media, the invention includes software for controlling the computer system 1201, for driving a device or devices for implementing the invention, and for enabling the computer system 1201 to interact with a human user. Such software may include, but is not limited to, device drivers, operating systems, development tools, and applications software. Such computer readable media further includes the computer program product of the invention for performing all or a portion (if processing is distributed) of the processing performed in implementing the invention.

The computer code devices of the invention may be any interpretable or executable code mechanism, including but not limited to scripts, interpretable programs, dynamic link libraries (DLLs), Java classes, and complete executable programs. Moreover, parts of the processing of the invention may be distributed for better performance, reliability, and/or cost.

The term "computer readable medium" as used herein refers to any medium that participates in providing instructions to the processor 1203 for execution. A computer readable medium may take many forms, including but not limited to, non-volatile media, volatile media, and transmission media. Non-volatile media includes, for example, optical, magnetic disks, and magneto-optical disks, such as the hard disk 1207 or the removable media drive 1208. Volatile media includes dynamic memory, such as the main memory 1204. Transmission media includes coaxial cables, copper wire and fiber optics, including the wires that make up the bus 1202. Transmission media may also take the form of acoustic or light waves, such as those generated during radio wave and infrared data communications.

The computer system 1201 can also include a communication interface 1213 coupled to the bus 1202. The communication interface 1213 provides a two-way data communication coupling to a network link 1214 that is connected to, for example, a local area network (LAN) 1215, or to another communications network 1216 such as the Internet. For example, the communication interface 1213 may be a network interface card to attach to any packet switched LAN. As another example, the communication interface 1213 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1213 sends and receives electrical, electromagnetic or optical signals that carry digital data streams representing various types of information.

The network link 1214 typically provides data communication through one or more networks to other data devices. For example, the network link 1214 may provide a connection to another computer through a local network 1215 (e.g., a LAN) or through equipment operated by a service provider, which provides communication services through a communications network 1216. In one embodiment, this capability permits the invention to have multiple of the above described controllers 500 networked together for purposes such as factory wide automation or quality control. The local network 1215 and the communications network 1216 use, for example, electrical, electromagnetic, or optical signals that carry digital data streams, and the associated physical layer (e.g., CAT 5 cable, coaxial cable, optical fiber, etc). The signals through the various networks and the signals on the network link 1214 and through the communication interface 1213, which carry the digital data to and from the computer system 1201 may be implemented in baseband signals, or carrier wave based signals. The baseband signals convey the digital data as unmodulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as unmodulated baseband data through a "wired" communication channel and/or sent within a predetermined frequency band, different than baseband, by modulating a carrier wave. The computer system 1201 can transmit and receive data, including program code, through the network(s) 1215 and 1216, the network link 1214, and the communication interface 1213. Moreover, the network link 1214 may provide a connection through a LAN 1215 to a mobile device 1217 such as a personal digital assistant (PDA) laptop computer, or cellular telephone.

Generalized Statements of the Invention

The following statements of the invention provide one or more characterizations of the present invention and do not limit the scope of the present invention.

Statement 1. A molten metal processing device comprising a molten metal containment structure for reception and transport of molten metal along a longitudinal length thereof; a cooling unit for the containment structure including a cooling channel for passage of a liquid medium therein; and an ultrasonic probe disposed in relation to the cooling channel such that ultrasonic waves are coupled through the liquid medium in the cooling channel and through the molten metal containment structure into the molten metal.

Statement 2. The device of statement 1, wherein the cooling channel cools the molten metal adjacent to the cooling channel to sub-liquidus temperatures (either lower than or less than 5-10° C. above the liquidus temperature of the alloy, or even lower than the liquidus temperature). The wall thickness of the cooling channel in contact with the molten metal has to be thin enough to ensure that the cooling channel can actually cool the molten metal adjacent to the channel to that temperature range. Statement 3. The device of statement 1, wherein the cooling channel comprises at least one of water, gas, liquid metal, and engine oils.

Statement 4. The device of statement 1, wherein the containment structure comprises side walls containing the molten metal and a bottom plate supporting the molten metal.

Statement 5. The device of statement 4, wherein the bottom plate comprises at least one of copper, irons or steel, niobium, or an alloy of niobium. Statement 6. The device of statement 4, wherein the bottom plate comprises a ceramic. Statement 7. The device of statement 6, wherein the ceramic comprises a silicon nitride ceramic. Statement 8. The device of statement 7, wherein the silicon nitride ceramic comprises a SIAlON. Statement 9. The device of statement 4, wherein the side walls and the bottom plate form an integrated unit. Statement 10. The device of statement 4, wherein the side walls and the bottom plate comprise different plates of different materials. Statement 11. The device of statement 4, wherein the side walls and the bottom plate comprise different plates of the same material.

Statement 12. The device of statement 1, wherein the ultrasonic probe is disposed in the cooling channel closer to a downstream end of the contact structure than an upstream end of the contact structure.

Statement 13. The device of statement 1, wherein the containment structure comprises a niobium structure. Statement 14. The device of statement 1, wherein the containment structure comprises a copper structure. Statement 15. The device of statement 1, wherein the containment structure comprises a steel structure. Statement 16. The device of statement 1, wherein the containment structure comprises a ceramic.

Statement 17. The device of statement 16, wherein the ceramic comprises a silicon nitride ceramic. Statement 18. The device of statement 17, wherein the silicon nitride ceramic comprises a SIAlON. Statement 19. The device of statement 1, wherein the containment structure comprises a material having a melting point greater than that of the molten metal. Statement 20. The device of statement 1, wherein the containment structure comprises a different material than that of the support. Statement 21. The device of statement 1, wherein the containment structure includes a downstream end having a configuration to deliver said molten metal with said nucleation sites into a mold.

Statement 22. The device of statement 21, wherein the mold comprises a casting-wheel mold. Statement 23. The device of statement 21, wherein the mold comprises a vertical casting mold. Statement 24. The device of statement 21, wherein the mold comprises a stationary mold.

Statement 25. The device of statement 1, wherein the containment structure comprises a metallic material or a refractory material. Statement 26. The device of statement 25, wherein the metallic material comprises at least one of copper, niobium, niobium and molybdenum, tantalum, tungsten, and rhenium, and alloys thereof. Statement 27. The device of statement 26, wherein the refractory material comprises one or more of silicon, oxygen, or nitrogen. Statement 28. The device of statement 25, wherein the metallic material comprises a steel alloy.

Statement 29. The device of statement 1, wherein the ultrasonic probe has an operational frequency between 5 and 40 kHz.

Statement 30. A method for forming a metal product, comprising transporting molten metal along a longitudinal length of a molten metal containment structure; cooling the molten metal containment structure by passage of a medium through a cooling channel thermally coupled to the molten metal containment structure; and coupling ultrasonic waves through the medium in the cooling channel and through the molten metal containment structure into the molten metal.

Statement 31. The method of statement 30, wherein transporting molten metal comprises transporting the molten metal in said containment structure having side walls containing the molten metal and a bottom plate supporting the molten metal.

Statement 32. The method of statement 31, wherein the side walls and the bottom plate form an integrated unit. Statement 33. The method of statement 31, wherein the side walls and the bottom plate comprise different plates of different materials. Statement 34. The method of statement 31, wherein the side walls and the bottom plate comprise different plates of the same material.

Statement 35. The method of statement 30, wherein coupling ultrasonic waves comprises coupling said ultrasonic waves from an ultrasonic probe which is disposed in the cooling channel closer to a downstream end of the contact structure than an upstream end of the contact structure.

Statement 36. The method of statement 30, wherein transporting molten metal comprises transporting the molten metal in a niobium containment structure. Statement 37. The method of statement 30, wherein transporting molten metal comprises transporting the molten metal in a copper contact structure. Statement 38. The method of statement 30, wherein transporting molten metal comprises transporting the molten metal in a copper containment structure. Statement 39. The method of statement 30, wherein transporting molten metal comprises transporting the molten metal in a structure comprising a material having a melting point greater than that of the molten metal.

Statement 40. The method of statement 30, wherein transporting molten metal comprises delivering said molten metal into a mold. Statement 41. The method of statement 40, wherein transporting molten metal comprises delivering said molten metal with said nucleation sites into the mold. Statement 42. The method of statement 41, wherein transporting molten metal comprises delivering said molten metal with said nucleation sites into a casting-wheel mold. Statement 43. The method of statement 41, wherein transporting molten metal comprises delivering said molten metal with said nucleation sites into a stationary mold. Statement 44. The method of statement 41, wherein transporting molten metal comprises delivering said molten metal with said nucleation sites into a vertical casting mold.

Statement 45. The method of statement 30, wherein coupling ultrasonic waves comprises coupling said ultrasonic waves with said frequency between 5 and 40 kHz. Statement 46. The method of statement 30, wherein coupling ultrasonic waves comprises coupling said ultrasonic waves with said frequency between 10 and 30 kHz. Statement 47. The method of statement 30, wherein coupling ultrasonic waves comprises coupling said ultrasonic waves with said frequency between 15 and 25 kHz. Statement 48. The method of statement 30, further comprising solidifying the molten metal to produce a cast metallic composition having sub-millimeter grain sizes with less than 5% of the composition including grain refiners. Statement 49. The method of statement 48, wherein the solidifying comprises producing said cast metallic composition with less than 1% of the composition including said grain refiners.

Statement 50. A system for forming a metal product, comprising the molten metal processing device of any one of the statements 1-29; and a controller including data inputs and control outputs, and programmed with control algorithms which permit operation of any one of the step elements recited in statements 30-49.

Statement 51. A metallic product comprising (or formed from) a cast metallic composition having sub-millimeter grain sizes and including less than 0.5% grain refiners therein. Statement 52. The product of statement 51, wherein the composition includes less than 0.2% grain refiners therein. Statement 53. The product of statement 51, wherein the composition includes less than 0.1% grain refiners therein. Statement 54. The product of statement 51, wherein the composition includes no grain refiners therein. Statement 55. The product of statement 51, wherein the composition includes at least one of aluminum, copper, magnesium, zinc, lead, gold, silver, tin, bronze, brass, and alloys thereof. Statement 56. The product of statement 51, wherein the composition is formed into at least one of a bar stock, a rod, stock, a sheet stock, wires, billets, and pellets such that the product is a post-casting product defined herein to be a product formed from the casting material and including less than 5% grain refiners. In a preferred embodiment, the post-casting product would have equiaxed grains. In a preferred embodiment, the post-casting product would have grain sizes between 100 to 500 micron, 200 to 900 micron, or 300 to 800 micron, or 400 to 700 micron, or 500 to 600 micron, such as for example in an aluminum or aluminum alloy casting. For copper and copper alloys, grain sizes range from 100 to 500 micron, 200 to 900 micron, or 300 to 800 micron, or 400 to 700 micron, or 500 to 600 micron. For gold, silver, or tin or alloys thereof, grain sizes range from 100 to 500 micron, 200 to 900 micron, or 300 to 800 micron, or 400 to 700 micron, or 500 to 600 micron. For magnesium or magnesium alloys, grain sizes range from 100 to 500 micron, 200 to 900 micron, or 300 to 800 micron, or 400 to 700 micron, or 500 to 600 micron.

Statement 57. An aluminum product comprising (or formed from) an aluminum cast metallic composition having sub-millimeter grain sizes and including less than 5% grain refiners therein. Statement 58. The product of statement 57, wherein the composition includes less than 2% grain refiners therein. Statement 59. The product of statement 57, wherein the composition includes less than 1% grain refiners therein. Statement 60. The product of statement 57, wherein the composition includes no grain refiners therein. The product of statement 57 can also be formed into at least one of a bar stock, a rod, stock, a sheet stock, wires, billets, and pellets such that the product is a post-casting product defined herein to be a product formed from the casting material and including less than 5% grain refiners. In a preferred embodiment, the post-casting aluminum product would have equiaxed grains. In a preferred embodiment, the post-casting product would have grain sizes between 100 to 500 micron, 200 to 900 micron, or 300 to 800 micron, or 400 to 700 micron, or 500 to 600 micron.

Statement 61. A system for forming a metal product comprising 1) means for transporting molten metal along a longitudinal length of a molten metal containment structure, 2) means for cooling the molten metal containment structure by passage of a medium through a cooling channel thermally coupled to the molten metal containment structure, 3) means for coupling ultrasonic waves through the medium in the cooling channel and through the molten metal containment structure into the molten metal, and 4) a controller including data inputs and control outputs, and programmed with control algorithms which permit operation of any one of the step elements-recited above.

Numerous modifications and variations of the present invention are possible in light of the above teachings. It is therefore to be understood that within the scope of the appended claims, the invention may be practiced otherwise than as specifically described herein.

The invention claimed is:

1. A molten metal processing device comprising:

a molten metal containment structure for reception and transport of molten metal along a longitudinal length thereof;

a cooling unit for the containment structure including a cooling channel for passage of a liquid cooling medium therein;

an ultrasonic probe inserted into the cooling channel such that ultrasonic waves are coupled through the liquid cooling medium in the cooling channel and through the molten metal containment structure into the molten metal.

2. The device of claim 1, wherein the cooling channel provides cooling to the molten metal so that the molten metal adjacent to the cooling channel reaches sub-liquidus temperature.

3. The device of claim 1, wherein the containment structure comprises side walls containing the molten metal and a bottom plate contacting the molten metal.

4. The device of claim 3, wherein the bottom plate comprises at least one of niobium, or an alloy of niobium.

5. The device of claim 3, wherein the bottom plate comprises a ceramic.

6. The device of claim 5, wherein the ceramic comprises a silicon nitride ceramic.

7. The device of claim 6, wherein the silicon nitride ceramic comprises a silica alumina nitride.

8. The device of claim 3, wherein the side walls and the bottom plate comprise different plates of different materials.

9. The device of claim 1, wherein the ultrasonic probe is disposed in the cooling channel closer to a downstream end of the containment structure than an upstream end of the containment structure.

10. The device of claim 1, wherein the containment structure comprises a niobium structure.

11. The device of claim 1, wherein the containment structure comprises a copper structure.

12. The device of claim 1, wherein the containment structure comprises a steel structure.

13. The device of claim 1, wherein the containment structure comprises a ceramic.

14. The device of claim 13, wherein the ceramic comprises a silicon nitride ceramic.

15. The device of claim 14, wherein the silicon nitride ceramic comprises a silica alumina nitride.

16. The device of claim 1, wherein the containment structure comprises a material having a melting point greater than that of the molten metal.

17. The device of claim 1, wherein the containment structure comprises a different material than that of the cooling channel.

18. The device of claim 1, wherein the containment structure includes a downstream end having a configuration to deliver said molten metal into a mold.

19. The device of claim 18, wherein the mold comprises a casting-wheel mold.

20. The device of claim 18, wherein the mold comprises a vertical casting mold.

21. The device of claim 18, wherein the mold comprises a stationary mold.

22. The device of claim 1, wherein the containment structure comprises a refractory material.

23. The device of claim 22, wherein the refractory material comprises at least one of copper, niobium, niobium and molybdenum, tantalum, tungsten, and rhenium, and alloys thereof.

24. The device of claim 23, wherein the refractory material comprises one or more of silicon oxygen, or nitrogen.

25. The device of claim 24, wherein the refractory material comprises a steel alloy.

26. The device of claim 1, wherein the ultrasonic probe has an operational frequency between 5 and 40 kHz.

27. A system for forming a metal product, comprising:

the molten metal processing device of claim 1; and a controller including data inputs and control outputs, and programmed with one or more control algorithms which control at least one of transporting the molten metal, cooling the molten metal, and coupling the ultrasonic waves into the molten metal.

28. A method for forming a metal product, comprising:

transporting molten metal along a longitudinal length of a molten metal containment structure;

cooling the molten metal containment structure by passage of a liquid cooling medium through a cooling channel thermally coupled to the molten metal containment structure; and coupling ultrasonic waves from an ultrasonic probe inserted into the cooling channel, wherein the waves are transmitted through the liquid cooling medium in the cooling channel and through the molten metal containment structure into the molten.

29. A system for forming a metal product, comprising:

means for transporting molten metal along a longitudinal length of a molten metal containment structure;

means for cooling the molten metal containment structure by passage of a liquid cooling medium through a cooling channel thermally coupled to the molten metal containment structure;

means for coupling ultrasonic waves from an ultrasonic probe inserted into the cooling channel, wherein the waves are transmitted through the liquid cooling medium in the cooling channel and through the molten metal containment structure into the molten metal; and a controller including data inputs and control outputs, and programmed with one or more control algorithms which control at least one of transporting the molten metal, cooling the molten metal, and coupling the ultrasonic waves into the molten metal.

* * * * *